US007090378B1

(12) United States Patent
Zadro

(10) Patent No.: US 7,090,378 B1
(45) Date of Patent: Aug. 15, 2006

(54) DUAL MAGNIFICATION FOLDING TRAVEL MIRROR WITH ANNULAR ILLUMINATOR

(76) Inventor: Zlatko Zadro, 5422 Argosy Dr., Huntington Beach, CA (US) 92649

( * ) Notice: Subject to any disclaimer, the term of this patent is extended or adjusted under 35 U.S.C. 154(b) by 0 days.

(21) Appl. No.: 10/743,676

(22) Filed: Dec. 22, 2003

(51) Int. Cl.
*F21V 7/18* (2006.01)

(52) U.S. Cl. ..... 362/298; 362/109; 362/300; 362/137; 362/139; 362/141; 362/143; 362/144

(58) Field of Classification Search ..... 362/298, 362/560, 577, 109, 253, 300, 297, 135, 136, 362/137, 138, 139, 140, 141, 142, 143, 144; 132/288, 296, 301, 316, 304, 302, 291; 206/581, 206/823
See application file for complete search history.

(56) References Cited

U.S. PATENT DOCUMENTS 1,761,393 A * 6/1930 Hoegger ..... 362/141
2,487,883 A * 11/1949 Le Baron ..... 132/288
2,515,437 A * 7/1950 Bisch et al. ..... 362/577
6,347,876 B1 * 2/2002 Burton ..... 362/141

* cited by examiner

*Primary Examiner*—Sandra O'Shea
*Assistant Examiner*—Sharon Payne
(74) *Attorney, Agent, or Firm*—William L. Chapin

(57) ABSTRACT

A portable travel mirror device includes a base, a handle pivotably mounted to the base, and a dual mirror assembly mounted to the handle which is pivotable and telescopically extendable between compact transport and upright use configurations, and includes a circular primary mirror frame holding a magnifying mirror encircled by a ring-shaped lamp energized by a power source within the base, and overlain by a diffuser ring. A secondary mirror pivotably and swivelably attached to the primary mirror frame has a different magnification factor, e.g., 1×, and is pivotable upwards from a travel position overlying and protecting the primary mirror to an upright use position, and is also swivelable into contact with the primary mirror frame, whereby light from the lamp is transmitted through the diffuser ring and a transparent secondary mirror bezel to illuminate objects in front of the primary or secondary mirror.

8 Claims, 25 Drawing Sheets

28
45
25
26
87
20
70
101
71
153
22

28
51
87
20
101
153
70
71
22

28
45
24
87
20
101
153
70
71
22

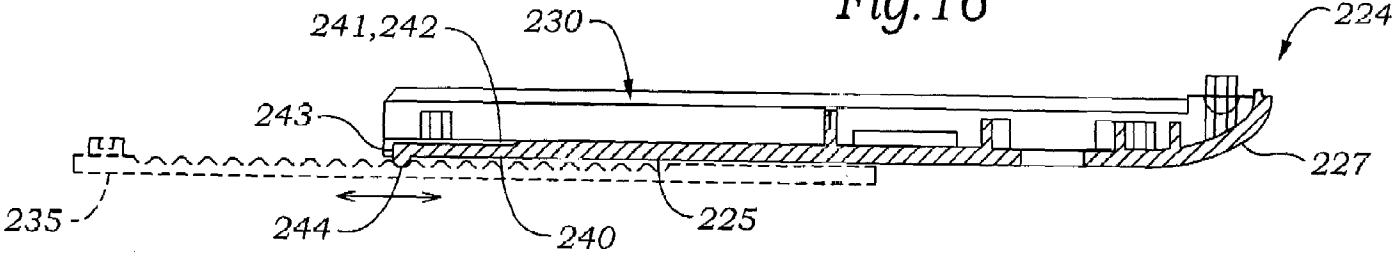
Fig. 16
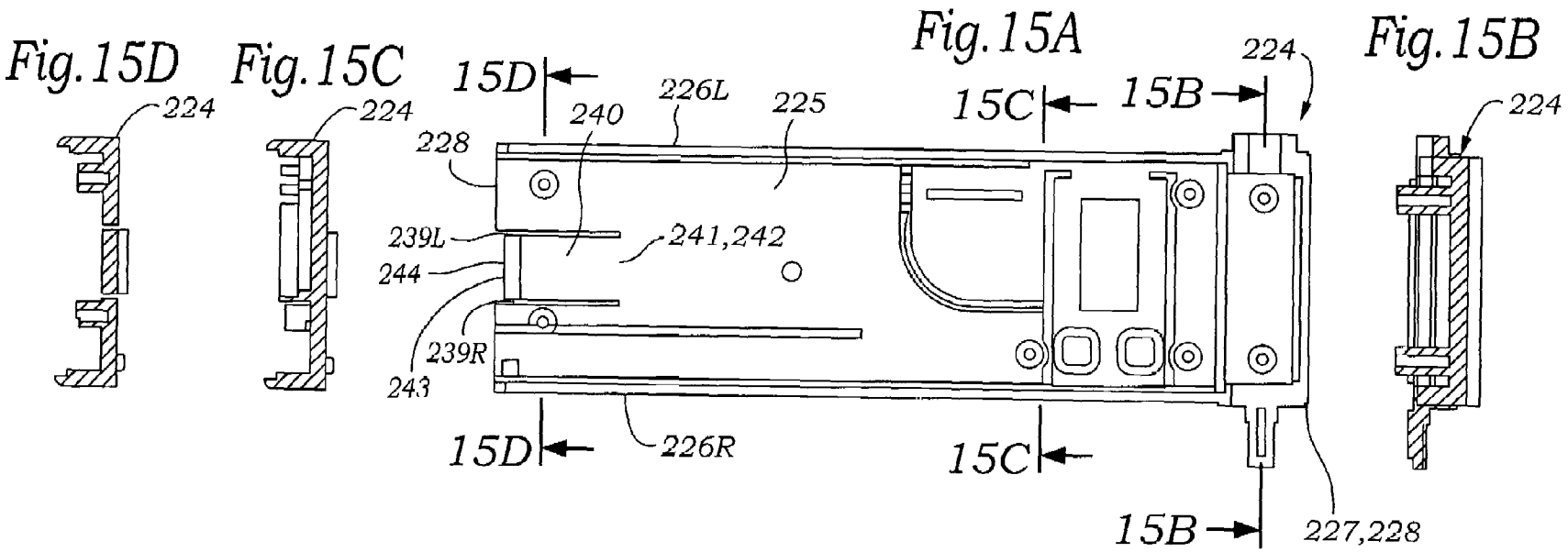
Fig. 15A
Fig. 15B
Fig. 15C
Fig. 15D

229

231
229

17A
17A
231
17D
229
229
17B
17B
17D

229

231
229

DUAL MAGNIFICATION FOLDING TRAVEL MIRROR WITH ANNULAR ILLUMINATOR

BACKGROUND OF THE INVENTION

A. Field of the Invention

The present invention relates to mirrors of the type used by people to facilitate performance of personal care functions such as shaving, applying cosmetics, and the like. More particularly, the invention relates to a novel travel mirror device which is collapsible into a compact, lightweight, readily transportable assembly, and which includes a pair of mirrors of different relative magnification and an integral annular illuminator which is effective in illuminating objects in front of both mirrors.

B. Description of Background Art

People who travel frequently to distant locations often must deal with the absence of conveniences which are taken for granted in their home environments. For example, women who perform grooming tasks such as applying cosmetics and the like typically perform such tasks at a customary location which is adequately lighted and which is provided with a fixed wall-mounted mirror, or a mirror which rests on a table, vanity or the like. However, lodgings at travel destinations usually do not have the optimal arrangements of lighting and seating located near a suitable mirror, such as one has available at his or her personal residence. Also, many people find it useful to have available mirrors with different magnification factors greater than the unitary or 1× imaging factor of conventional flat mirrors. For example, mirrors having 5× or 9× magnification factors are useful in facilitating the performance of detailed grooming procedures. But most travel lodgings have at best 1× flat mirrors which do not provide magnified images.

In view of the foregoing considerations, it would be desirable to have a mirror device which has multiple magnification factors, and an integral light source for illuminating an object such as a person's face within the object field of the mirror. Moreover, it would be desirable to have a dual magnification mirror with an integral illumination source, which could be folded into a lightweight, compact configuration in which reflecting surfaces of two mirrors were protectively enclosed for transport in a purse, briefcase or the like, yet be readily unfoldable at a use site such as a hotel room to deploy for use a mirror of selected magnification, adequate size, and adjustable orientation. The present inventor is unaware of any existing mirror device which possesses the foregoing characteristics and the unavailability of the desired combination of features was a factor motivating the present invention.

OBJECTS OF THE INVENTION

An object of the present invention is to provide a portable illuminated, dual magnification mirror device which is sufficiently small and light in weight to be conveniently and safely transportable in a traveler's luggage, carry-on bag, purse or briefcase.

Another object of the invention is to provide an illuminated travel mirror which includes a mirror assembly that includes a first or primary mirror having a first magnification and a peripheral annular illumination source which is effective in illuminating an object field in front of the primary mirror.

Another object of the invention is to provide an illuminated travel mirror which includes a peripherally illuminated primary mirror having a first image magnification factor, and a secondary mirror having a second image magnification factor which is mounted to an edge of a frame holding the primary mirror by a hinge coupler that enables the secondary mirror to be pivoted from a compact transit and storage configuration overlying and covering the primary mirror to a use configuration deployed radially outwardly from the primary mirror.

Another object of the invention is to provide an illuminated travel mirror which includes a primary mirror mounted in a primary frame provided with a peripheral annular illuminator, a secondary mirror mounted in a secondary frame which has a peripheral light-transmissive annular ring-shaped bezel, and a hinge coupler provided with a pivotable joint which connects peripheral edges of the primary and secondary frames and which enables the secondary mirror to be pivoted to a position overlying the main mirror frame, enabling light from the illuminator of the primary mirror frame to be transmitted through the light transmissive bezel of the secondary mirror and thereby illuminate an object field in front of the secondary mirror.

Another object of the invention is to provide an illuminated travel mirror which includes a base, an elongated handle which has a lower end pivotably mounted to the base by a handle joint, a dual mirror assembly telescopically mounted to an upper end of the handle assembly and which includes a first, primary mirror frame which holds a circular primary mirror that is effective in producing reflected images having a first magnification factor and an annular ring-shaped peripheral illumination source that at least partially circumscribes the primary mirror, a secondary, upper mirror frame which is pivotably connected by a hinge coupler to an upper part of the primary mirror frame at a location opposite to the end joined to the handle and which includes a second, secondary mirror having a different magnification factor than that of the primary mirror and which is circumscribed by a light transmissive peripheral frame portion or bezel, the hinge coupler connecting the secondary frame to the primary frame being so constructed as to enable the secondary mirror frame to be pivoted about a transverse axle of the hinge coupler away from a compact storage and transit configuration overlying the primary mirror frame to a use configuration disposed radially outwardly from the primary mirror frame, whereby the annular illumination source is enabled to illuminate an object field in front of the primary mirror, and whereby the secondary mirror frame is rotatable about a radially disposed swivel axis of the hinge coupler to position the reflective surface of the secondary mirror facing away from the primary mirror, and the secondary mirror frame pivoted towards an orientation overlying the primary mirror and illumination source, whereby light from the illumination source is enabled to be transmitted through the annular light-transmissive bezel ring of the secondary mirror, and thereby illuminate an object field in front of the reflective surface of the secondary mirror.

Various other objects and advantages of the present invention, and its most novel features, will become apparent to those skilled in the art by perusing the accompanying specification, drawings and claims.

It is to be understood that although the invention disclosed herein is fully capable of achieving the objects and providing the advantages described, the characteristics of the invention described herein are merely illustrative of the preferred embodiments. Accordingly, I do not intend that the scope of my exclusive rights and privileges in the invention be limited to details of the embodiments described. I do intend that equivalents, adaptations and modifications of the invention reasonably inferable from the description contained herein be included within the scope of the invention as defined by the appended claims.

SUMMARY OF THE INVENTION

Briefly stated, the present invention comprehends a portable travel mirror device which includes a pair of mirrors having different magnification factors, e.g., 1× and 5×, and an annular illumination source which is effective in selectably illuminating object fields of both mirrors.

A dual magnification portable travel mirror with annular illuminator according to the present invention includes a base that has a generally flat lower surface for resting on a horizontal support surface, or optionally hanging on a wall. The travel mirror includes a mirror assembly support handle which is mounted to the base by a handle pivot joint that has a horizontally disposed pivot axis which enables the handle to be pivoted upwardly, from a compact storage/travel position in which the handle lies in a longitudinally fore and aft disposed groove in the upper surface of the base, parallel to the lower surface of the base, to an upstanding use position. The handle pivot joint includes a laterally disposed friction pad between the outer surface of a laterally disposed cylindrical axle located at a lower end of the handle, and the inner surface of a laterally disposed cylindrical cavity located within a front portion of the base. The handle pivot joint also includes a friction control thumb screw which exerts an adjustable axially directed compressive force on one or more cylindrical friction disk that bears against an end face of the handle axle. Combined radial and axial frictional forces exerted by the friction pad and disks, respectively, maintain the handle fixed at an adjustable elevation angle above the base.

The travel mirror according to the present invention includes a dual mirror assembly which is telescopically mounted to an upper part of the mirror assembly support handle. The dual mirror assembly includes a circular dish-shaped primary mirror frame which has a generally flat front surface and a convex rear surface that has a circular perimeter and which is joined to the front surface of the frame by a convex, arcuately radiused annular edge wall. An elongated hollow rectangular handle boss tube protrudes outwardly from the rear surface of the primary frame, the boss being disposed symmetrically along a diameter of the rear frame surface between the flat circular portion of the rear frame surface, and the radiused edge wall. and extending nearly the full diameter of the mirror. The handle boss has a closed, rearwardly angled upper transverse end wall and a lower transverse end wall penetrated by a rectangular cross section channel which extends internally within the boss to the upper transverse end wall.

The handle boss channel telescopically receives the upper end of the rectangular cross-section handle. Inside the channel is located a longitudinally elongated detent plate provided with a series of longitudinally spaced apart, laterally disposed detent grooves in a rear surface of the plate, which is located at the front or inner wall of the channel. Also, the front or upper longitudinally elongated rectangular wall of the handle has at upper end thereof a laterally disposed detent rib which is urged resiliently forward towards the grooved surface of the detent plate. The detent rib has an arcuately curved, generally semi-cylindrically shaped transverse cross section, i.e., is radiused, and is of the proper size and shape to snap resiliently into an adjacent detent groove when aligned therewith, and require a relatively large longitudinal force to be exerted on the handle to disengage the rib from the groove. Thus constructed, the primary mirror assembly is telescopically extendable and retractable with respect to the handle, to an adjustable position which is maintained by cooperative action of the detent rib and a detent groove.

The primary mirror frame has in a front part thereof a shallow circular dish-shaped cavity in which is mounted a circular mirror of smaller diameter than the outer diameter of the frame. An annular ring-shaped peripheral channel around the mirror cavity holds a ring-shaped illumination source, preferably a thin, tubular cold-cathode fluorescent lamp. The lamp is energized by a high-voltage electrical current generated by a dc-to-ac inverter located in a hollow interior space within the base of the travel mirror and powered by batteries also located in the base. The front surface of the annular lamp channel is covered by an annular ring-shaped window which preferably has a diffusive light transmission. When the lamp is energized, a circular ring-shaped pattern of light emitted from the lamp and which is transmitted through the window is effective in illuminating an object field in front of the primary mirror. In a preferred embodiment, the primary mirror has a concave spherical shape which provides a magnified image of objects in front of the mirror, such as a person's face. The magnification factor of the primary mirror, which is inversely related to its radius of curvature, may be any desired value, but typically is in the range of 5× to 9×.

According to the present invention, the mirror assembly includes a circular secondary mirror which has a different magnification factor than that of the primary mirror, e.g., 1× vs. 5×–9×. The secondary mirror is mounted in a circular frame which is pivotably mounted by a dual-joint hinge coupler at an outer, lower peripheral edge thereof to an outer, upper peripheral edge of the primary mirror frame. Preferably, the secondary mirror frame has an outer diameter approximating that of the primary mirror frame, and is pivotable downwardly to overlie the primary mirror, with the reflective side of the secondary mirror facing that of the primary mirror thereby protecting both primary and secondary mirrors when the travel mirror is telescopically and pivotably configured to a compact configuration for storage or travel. The secondary mirror frame has a circular plate-like shape which includes a generally flat, annular ring-shaped outer peripheral or bezel portion made of a light transmissive material. Also, the secondary mirror preferably has a diameter approximately equal to, or less than, that of the primary mirror.

The hinge coupler which joins the secondary mirror to the primary mirror has two bearing axes, including a first, transverse pivot axis disposed along the center line of a transversely disposed axle which is parallel to a tangent to an upper peripheral edge of the primary mirror frame, and which pivotably supports the bushing of a hinge member fastened to a lower peripheral edge of the secondary mirror frame. The hinge coupler includes a second, swivel axis which lies along a center line of a swivel pin that protrudes radially outwardly from the lower edge of the secondary mirror frame and which is rotatable in a radially disposed journal bore centered between opposite sides of the pivot bushing. Thus constructed, the hinge coupler enables the secondary mirror frame to be pivoted away from a protective orientation overlying the primary mirror, to an upwardly angled orientation in which the surface of the secondary mirror faces generally forward, so that a person may view his or her face in either the primary mirror or the secondary mirror. Moreover, the primary mirror frame can be swiveled 180 degrees about the radially disposed swivel pin to thus position the reflecting surface of the s tation overlying the primary mirror, to an upwardly angled orientation in which the surface of the secondary econdary mirror in a rearward direction, away from that of the primary mirror. With the secondary mirror thus swiveled, the secondary mirror frame is pivotable downwardly to a position overlying and generally parallel to the upper surface of the secondary mirror, thus positioning the reflecting surface of the secondary mirror in the same forward-facing direction as that of the primary mirror. In this disposition, light emitted by the annular illumination source and transmitted through the annular ring-shaped window of the primary mirror frame is transmitted through the annular light transmissive bezel ring of the secondary mirror frame, thus illuminating an object field located in front of the secondary mirror.

BRIEF DESCRIPTION OF THE DRAWINGS

FIG. 15A is a front elevation view of a front body shell portion of the handle of the mirror of FIG. 1.

FIG. 15B is a transverse vertical sectional view of the handle shell of FIG. 15A, taken in the direction of line 15B—15B.

FIG. 15C is a transverse vertical sectional view of the handle shell of FIG. 15A, taken in the direction of line 15C—15C.

FIG. 15D is a transverse vertical sectional view of the handle shell of FIG. 15A, taken in the direction of line 15D—15D.

FIG. 16 is a longitudinal sectional view of the handle shell of FIG. 15A.

DESCRIPTION OF THE PREFERRED EMBODIMENTS

Figure 1B:
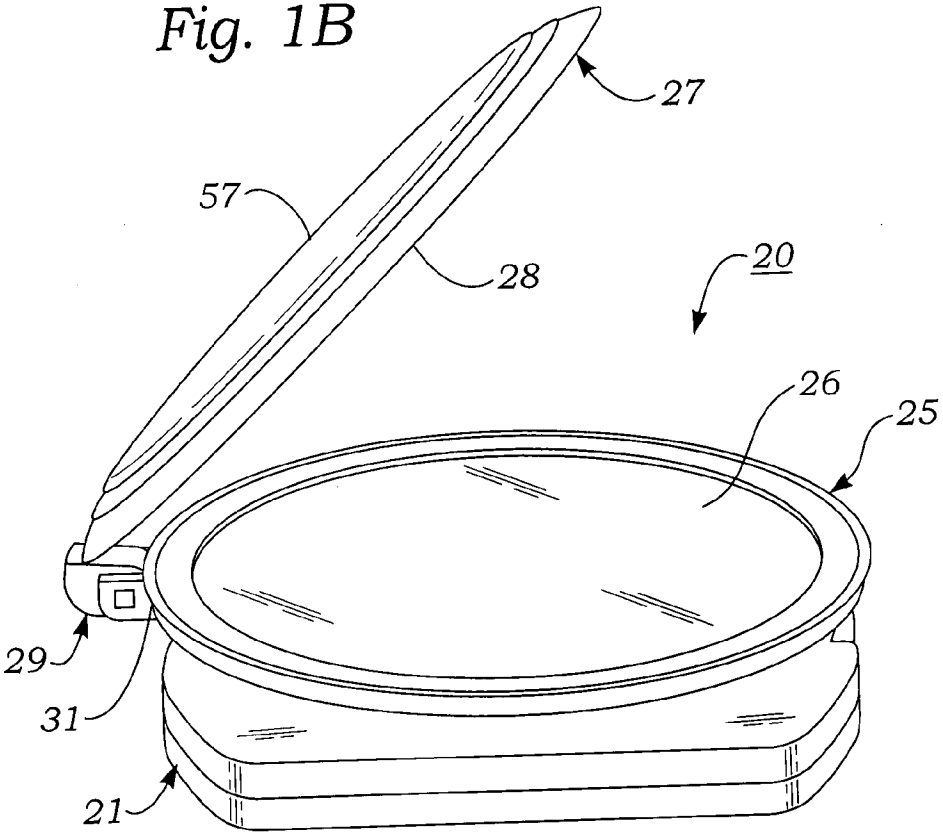
FIG. 1B is a left perspective view of the travel mirror device of FIG. 1A, showing a secondary mirror frame thereof pivoted upwardly from a dual mirror assembly of the device.
Figure 1A:
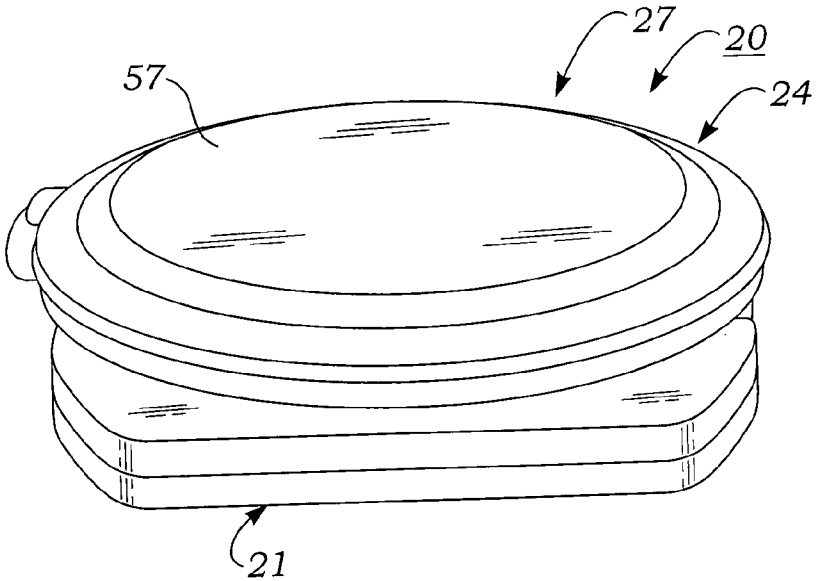
FIG. 1A is a left side perspective view of a dual magnification travel mirror device with annular illuminator according to the present invention, showing the device in a fully telescopically and pivotably collapsed configuration suitable for travel.
Figure 1D:
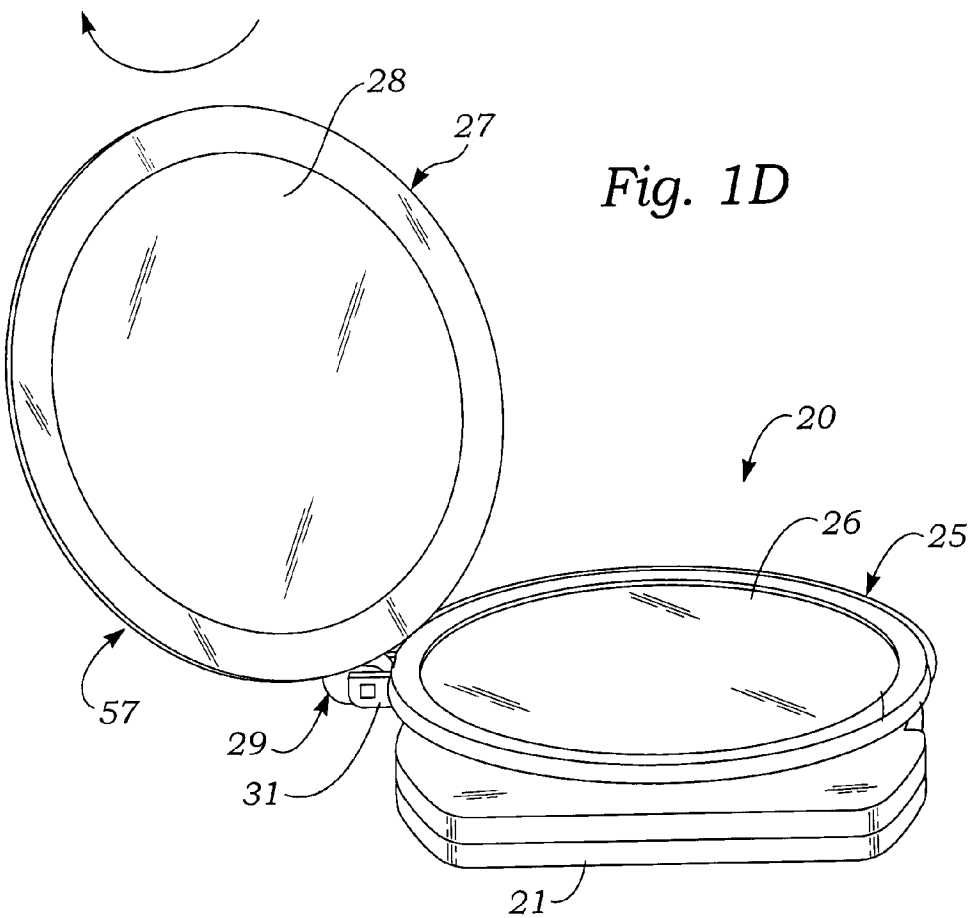
FIG. 1D is a left perspective view of the travel mirror device of FIG. 1B, showing a secondary mirror frame thereof swiveled partially rearwardly.
Figure 1C:
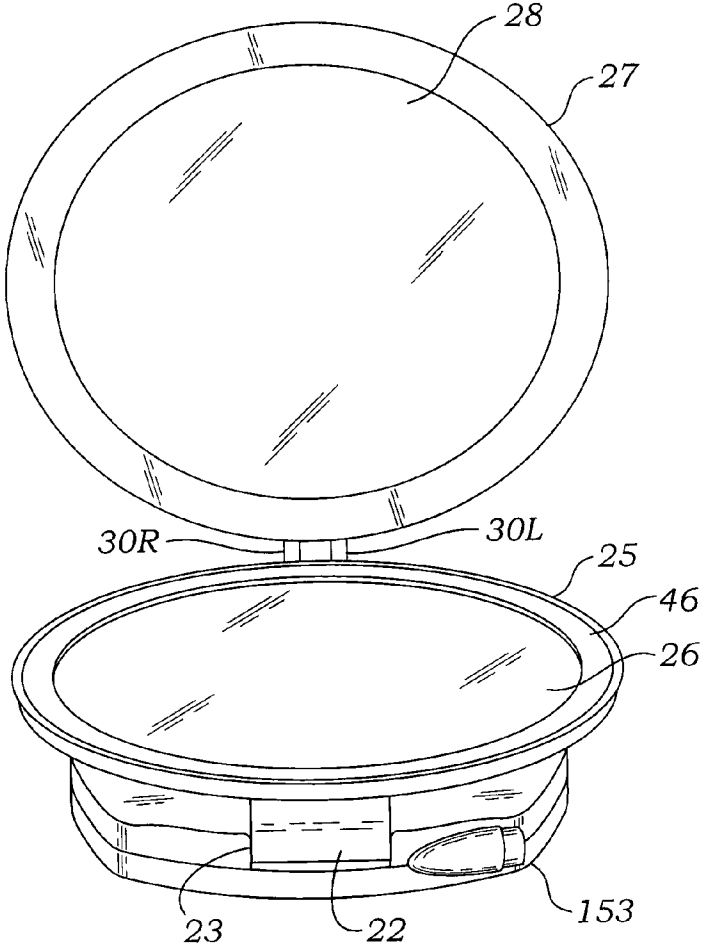
FIG. 1C is a front perspective view of the device of FIG. 1B.
Figure 1E:
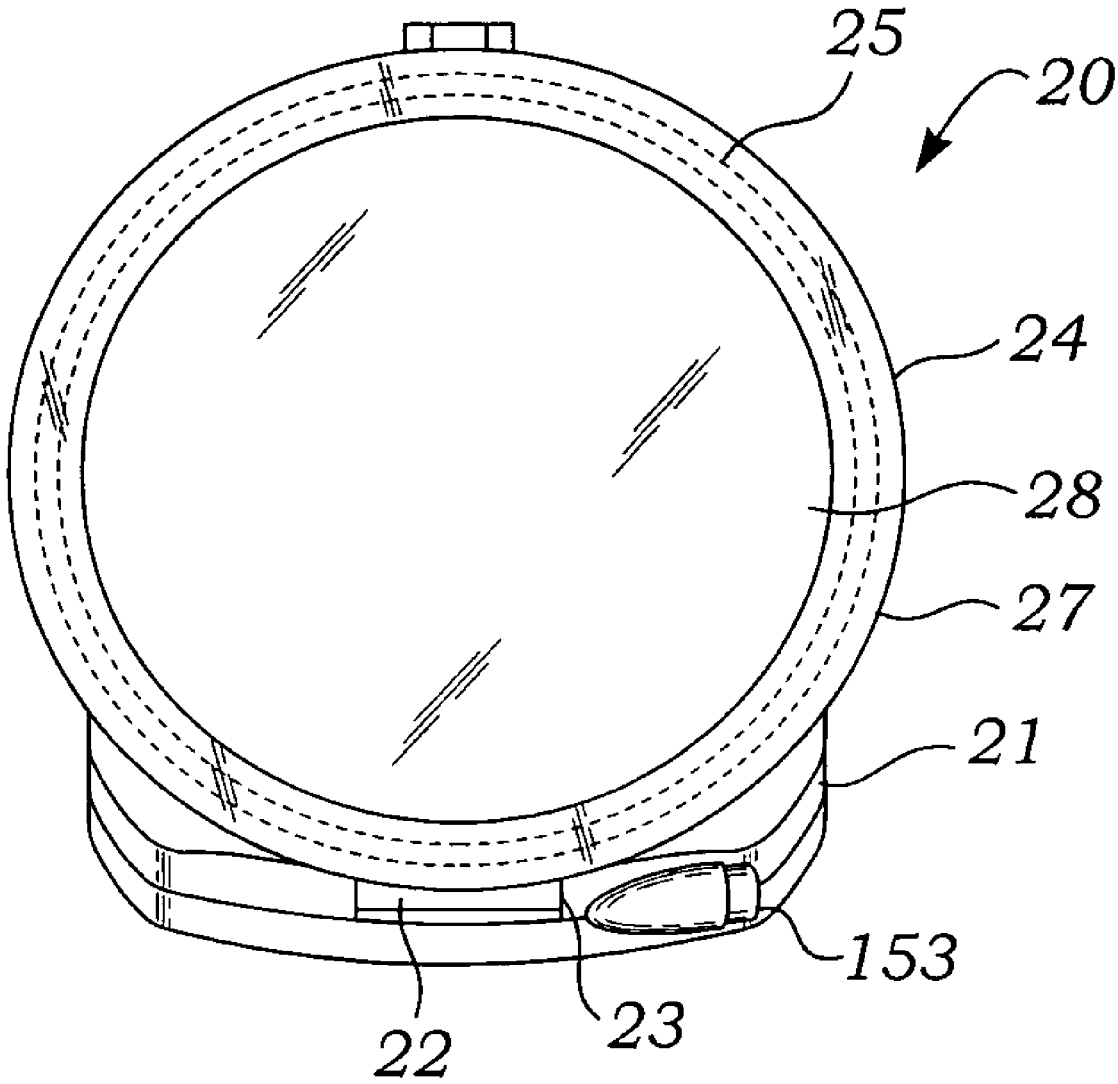
FIG. 1E is a front perspective view showing the secondary mirror frame swiveled 180 degrees from its disposition in FIG. 1A, and pivoted downwardly into a partial overlying use position relative to a primary mirror and base part of the device.

FIGS. 1A–21 illustrate various aspects of a dual magnification folding travel mirror with annular illuminator according to the present invention.

Referring first to FIGS. 1A–8A, it may be seen that a dual magnification travel mirror with annular illuminator 20 according to the present invention includes a base 21, an elongated, generally rectangularly-shaped handle 22 pivotably mounted at a lower end thereof to a front edge of the base by a handle pivot joint 23, and a dual mirror assembly 24 telescopically mounted to an upper end of the handle.

Figure 7B:
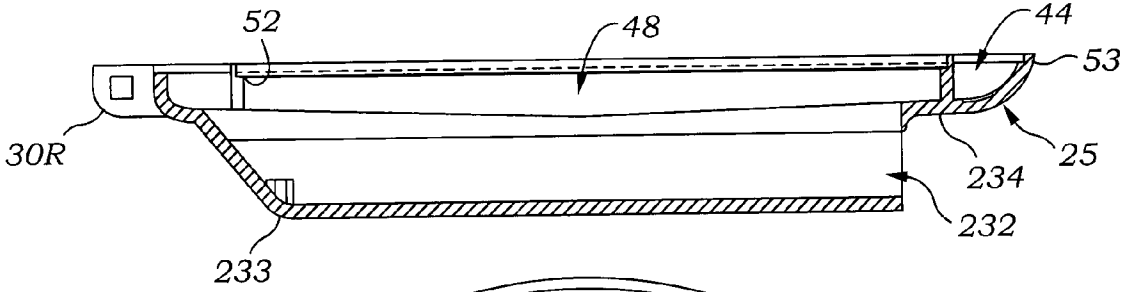
FIG. 7B is a longitudinal sectional view of the primary mirror frame of FIG. 7A.
Figure 7A:
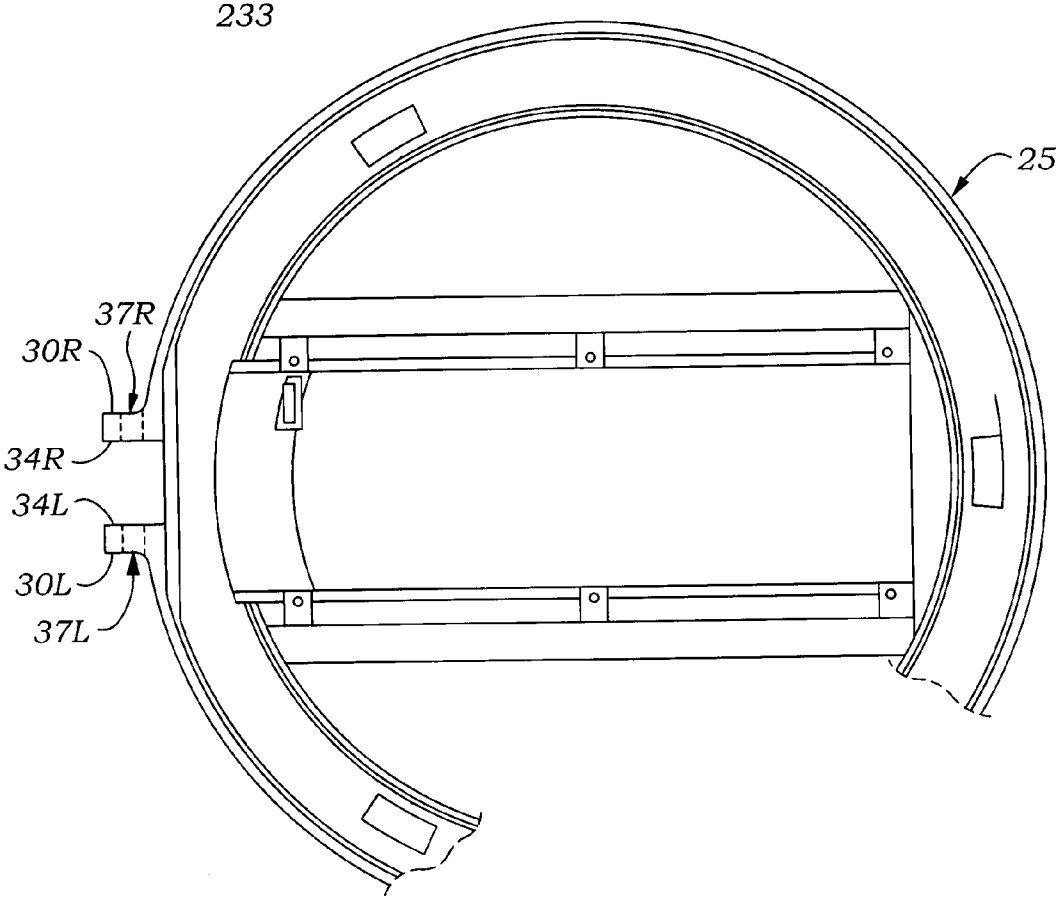
FIG. 7A is a fragmentary upper plan view of a primary mirror frame of the dual mirror assembly of FIG. 6A.
Figure 7D:
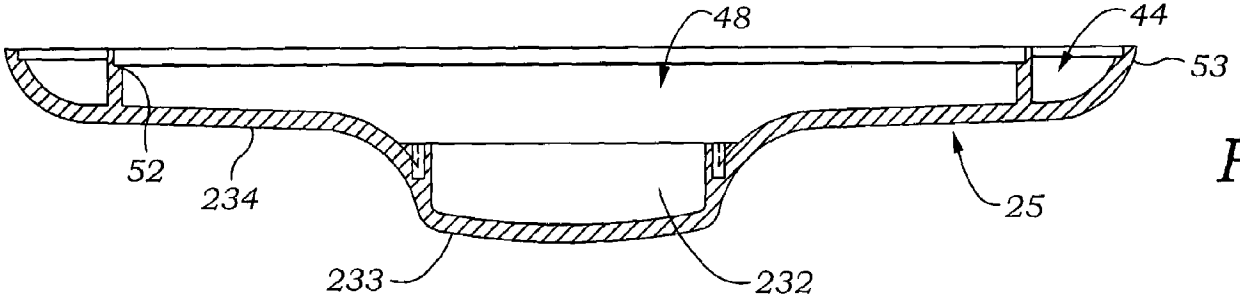
FIG. 7D is a sectional view of the frame of FIG. 7C, taken in the direction of line 7D—7D.
Figure 7C:
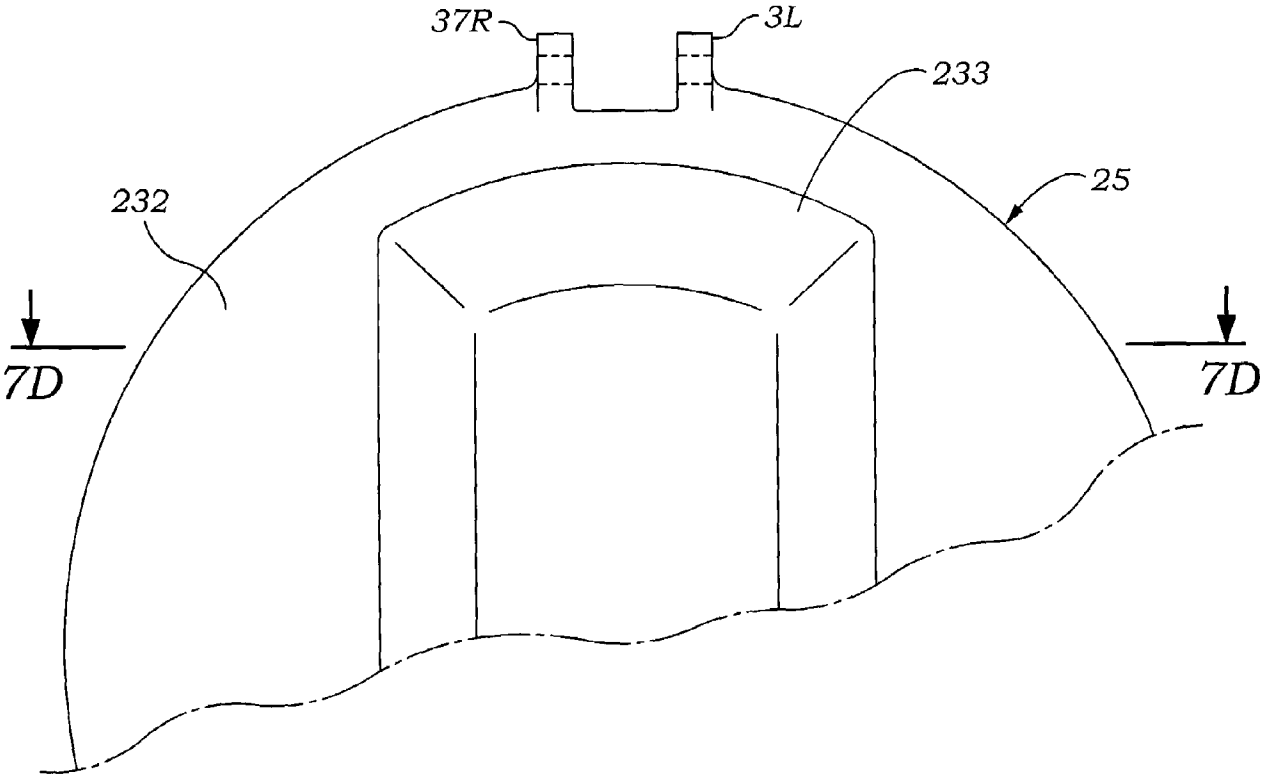
FIG. 7C is a fragmentary lower plan view of the primary mirror frame of FIG. 7A.
Figure 7F:
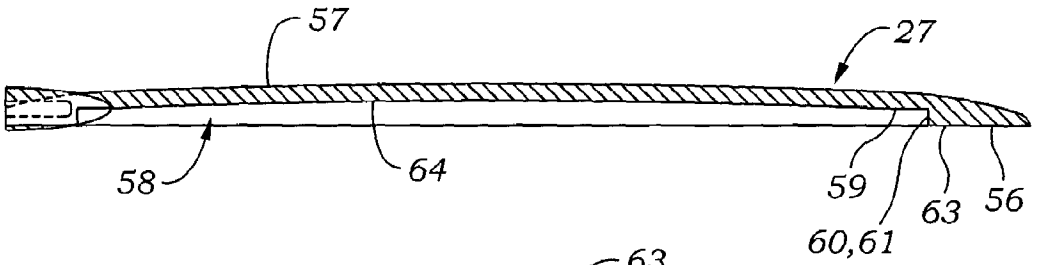
FIG. 7F is a longitudinal sectional view of the secondary mirror frame of FIG. 7E.
Figure 7E:
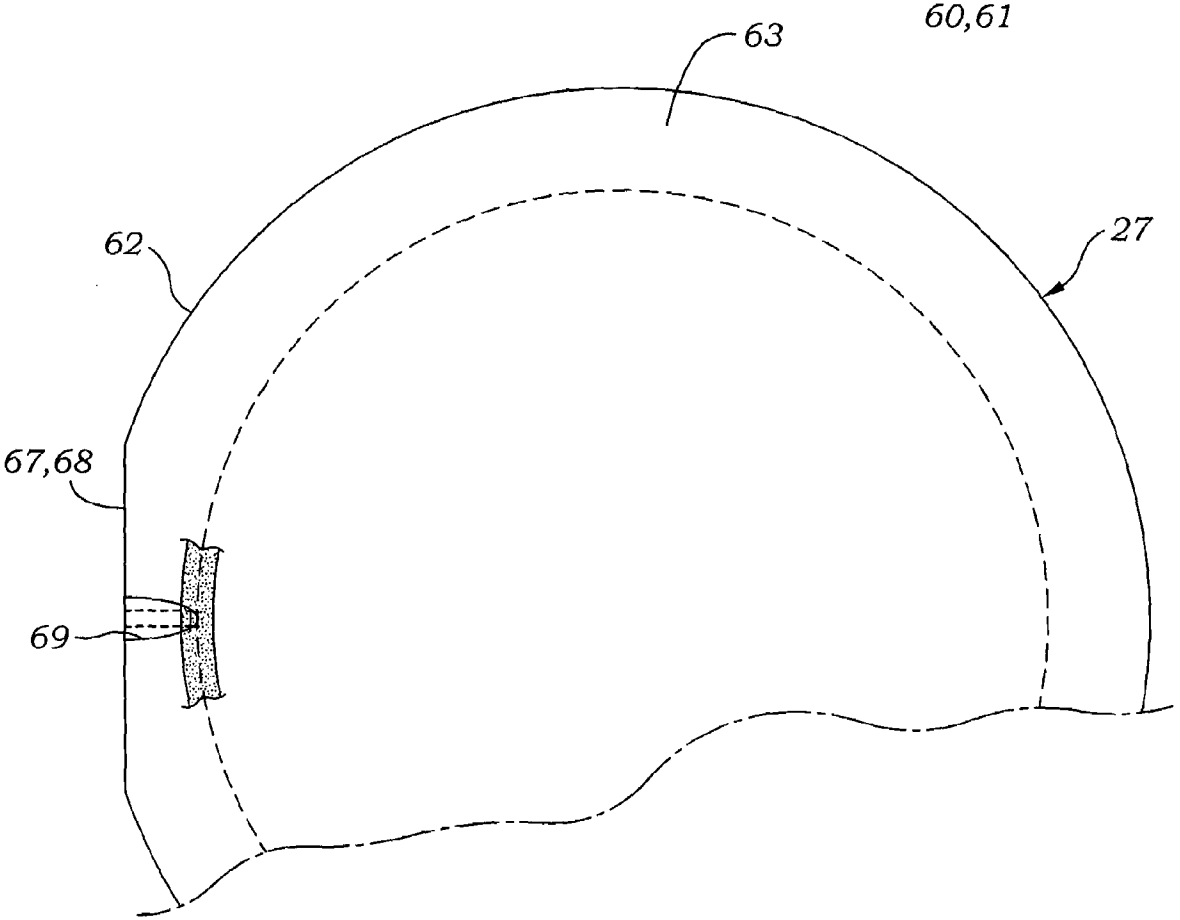
FIG. 7E is a fragmentary upper plan view of a secondary mirror frame of the dual mirror assembly of FIG. 6A.
Figure 8A:
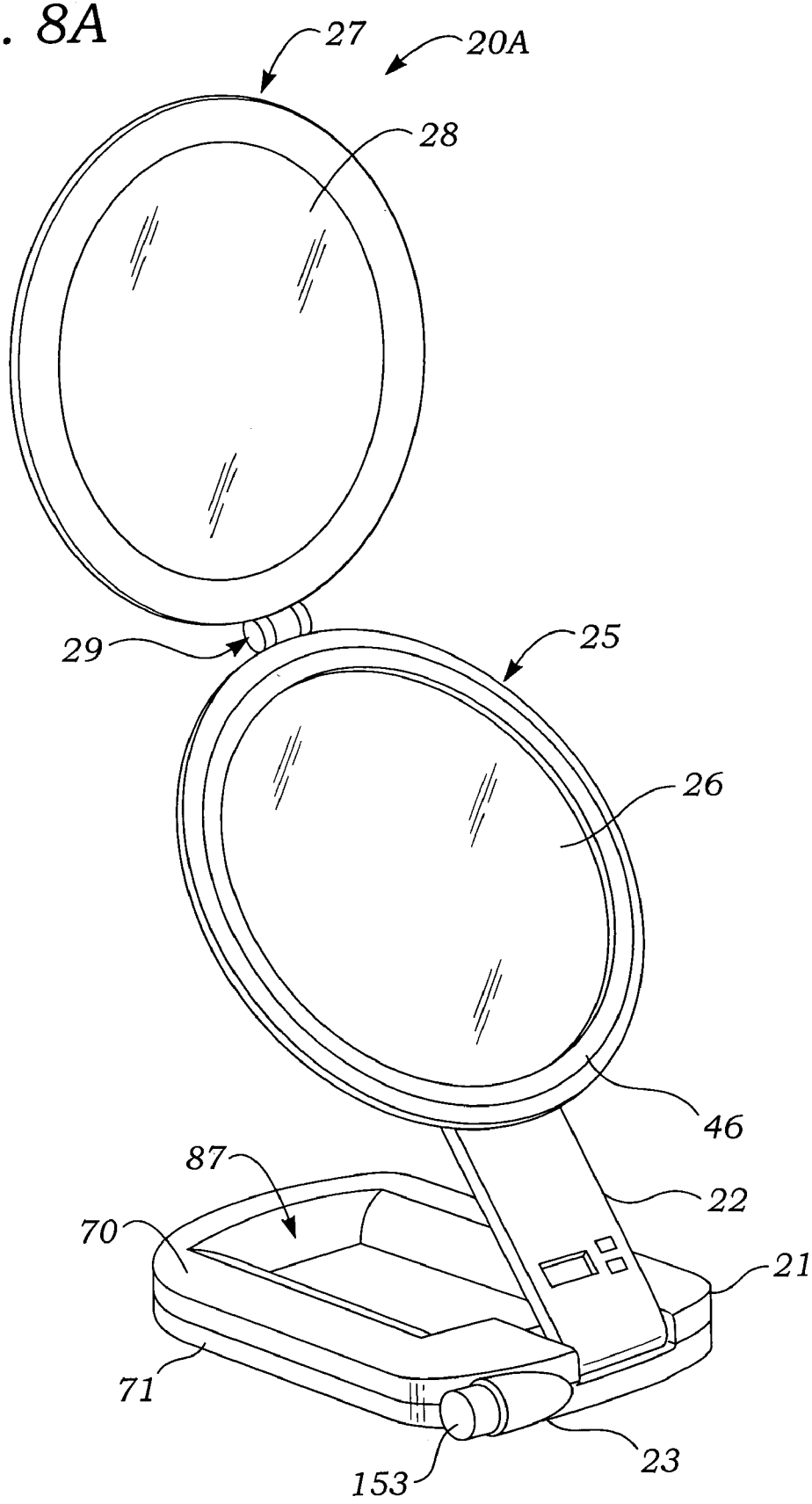
FIG. 8A is a front perspective view of the left-hand mirror device of FIG. 3A, showing the handle pivoted rearwardly to an oblique angle, and showing an upper, secondary mirror of the dual mirror assembly pivoted upwardly away from a lower, primary mirror thereof.
Figure 8C:
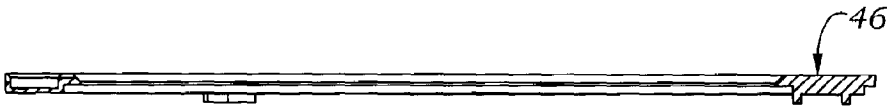
FIG. 8C is a longitudinal sectional view of the diffuser plate of FIG. 8B.
Figure 8B:
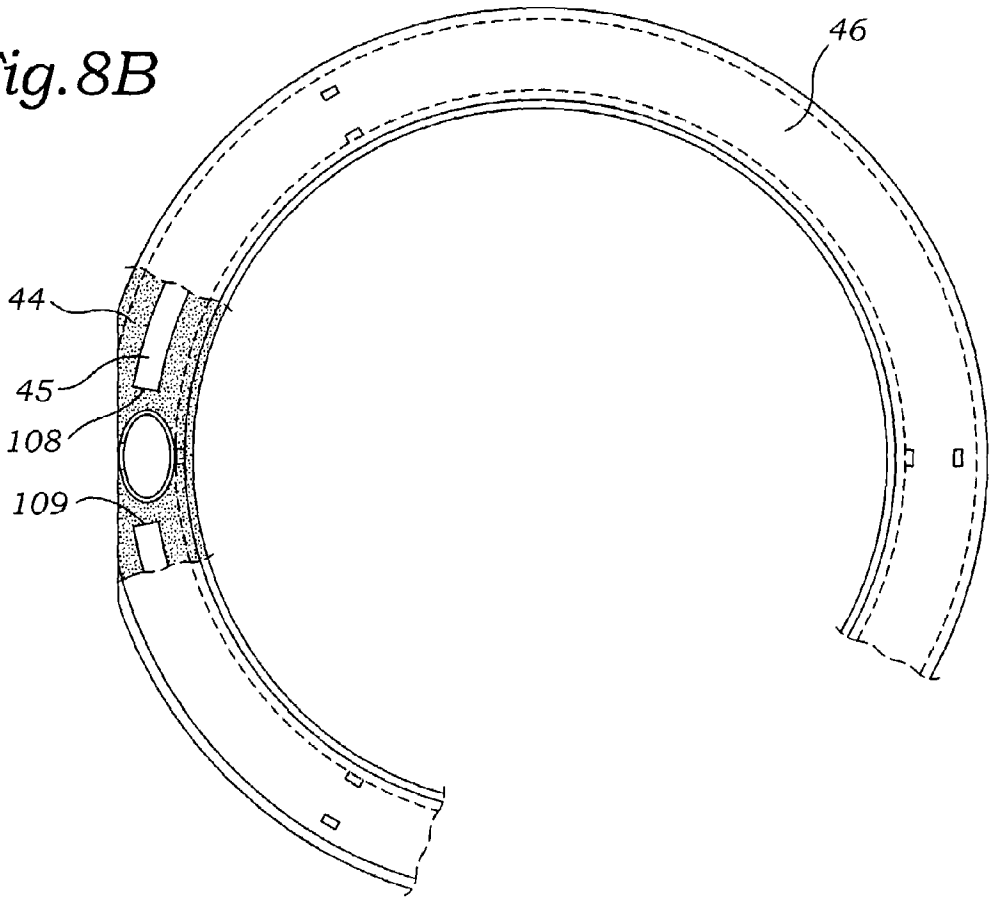
FIG. 8B is a fragmentary front elevation view of an annular diffuser plate for the primary mirror frame of FIG. 1.
Figure 9:
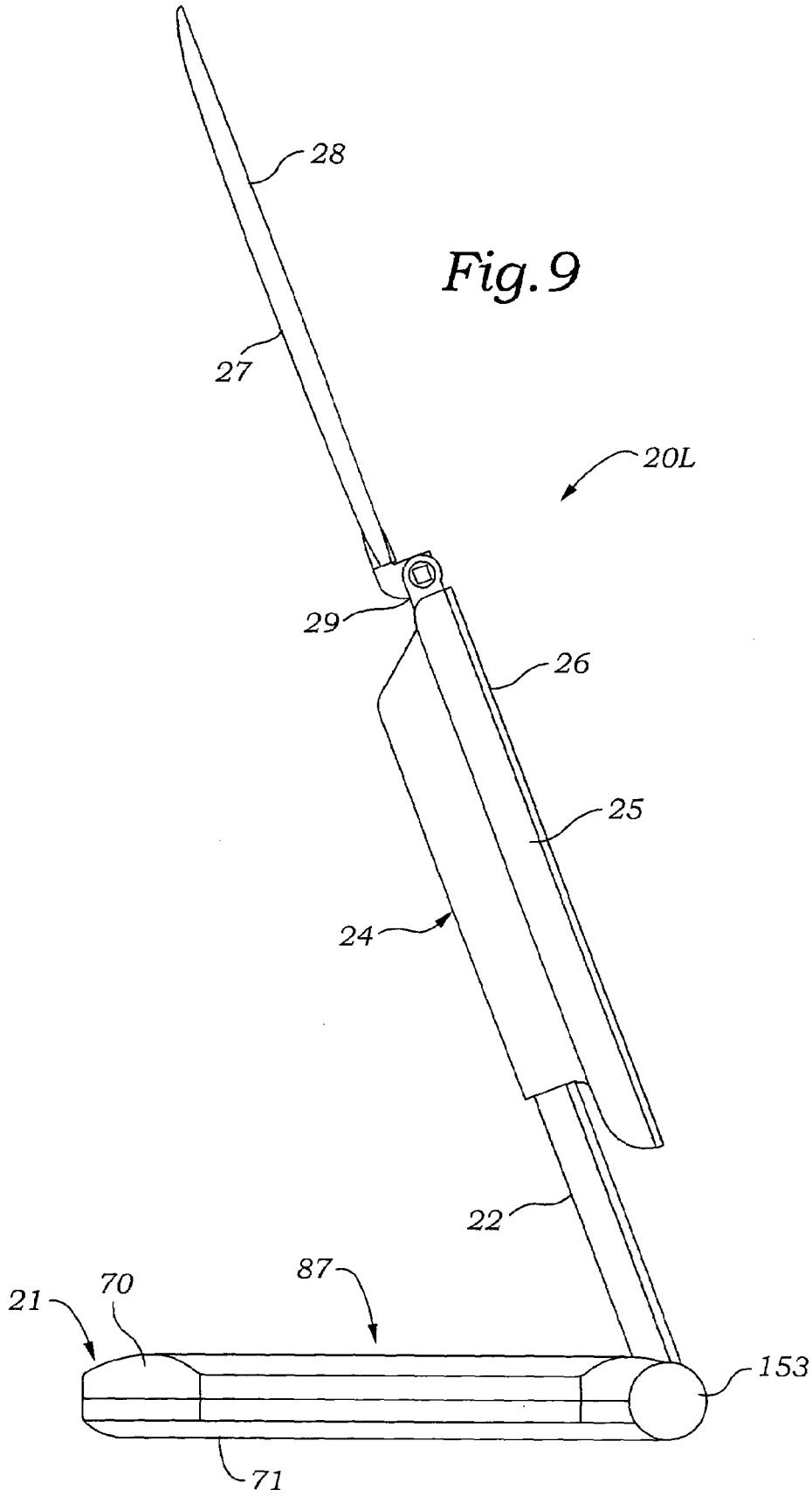
FIG. 9 is a side elevation view of the device arrangement of FIG. 8A.

As shown in FIGS. 6A–9, dual mirror assembly 24 includes a first, lower, or primary circular dish-shaped mirror frame 25 in which is mounted a first, lower or primary circular disk-shaped mirror 26. As is also shown in those figures, dual mirror assembly 24 includes a second, upper or secondary circular plate-shaped mirror frame 27 in which is mounted a second, upper or secondary circular disk-shaped secondary mirror 28. As shown in FIGS. 8A and 9, secondary mirror frame 27 is pivotably and swivelably coupled to primary mirror frame 25 by a dual joint hinge coupler 29. As shown in FIGS. 7A–9, hinge coupler 29 is joined to primary mirror frame 25 by a pair of circumferentially spaced apart, parallel lugs 30L, 30R which protrude chordally outwards from an upper peripheral portion 31 of primary mirror frame 25.

Figure 6A:
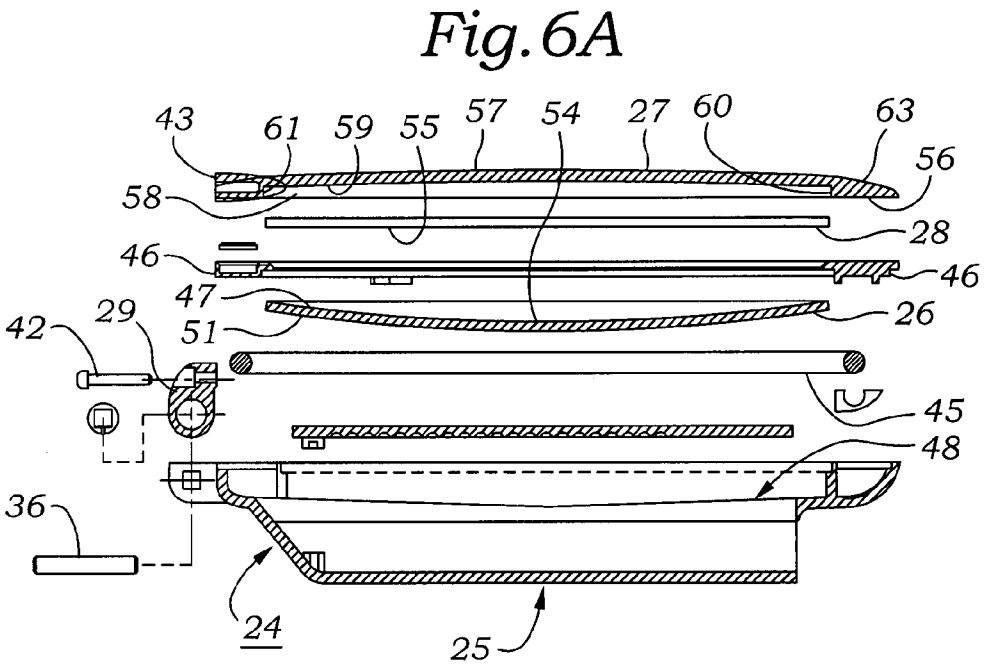
FIG. 6A is an exploded longitudinal sectional view of dual mirror assembly of the device of FIG. 1.
Figure 6F:
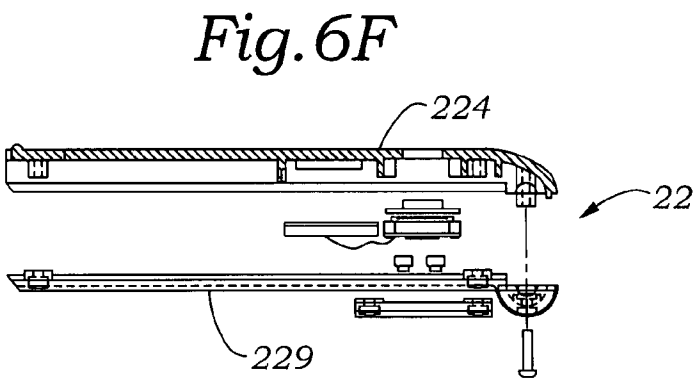
FIG. 6F is an exploded sectional view of a handle component of the mirror device of FIG. 1.
Figure 6E:
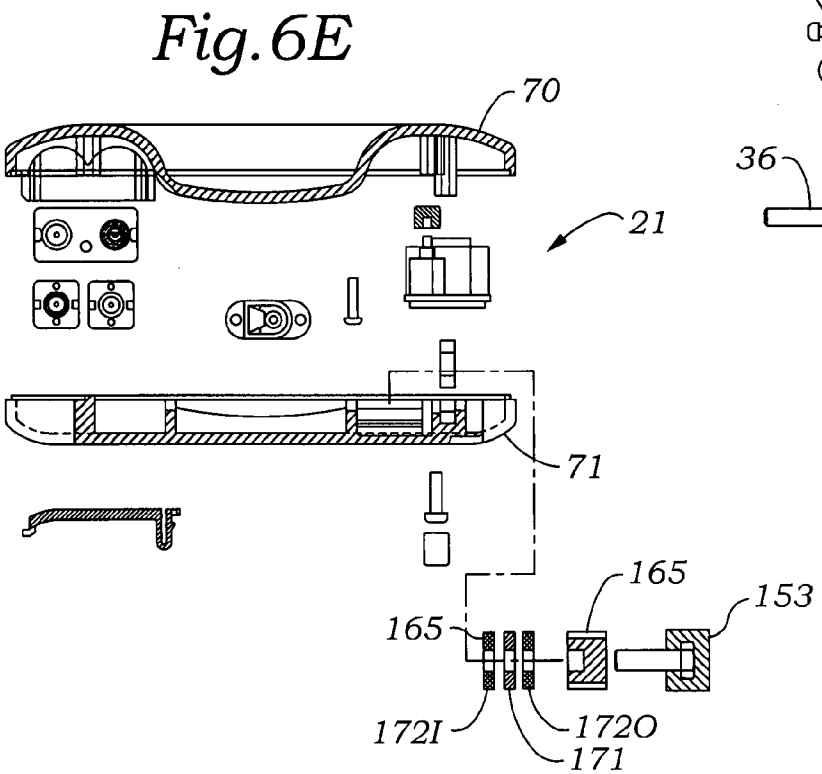
FIG. 6E is an exploded sectional view of a base component of the mirror device of FIG. 1.
Figure 6B:
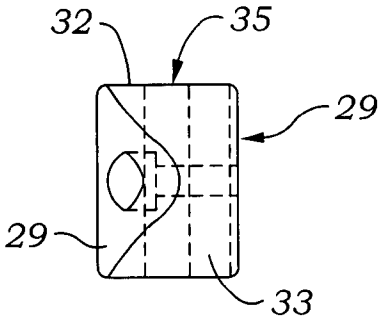
FIG. 6B is an upper plan view of a hinge coupler for the dual mirror assembly of FIG. 6A.
Figure 6D:
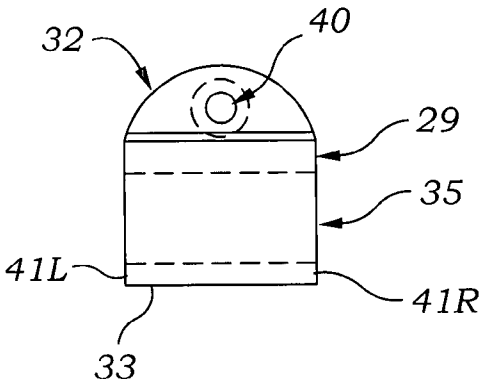
FIG. 6D is an upper plan view of the hinge coupler of FIG. 6A.
Figure 6C:
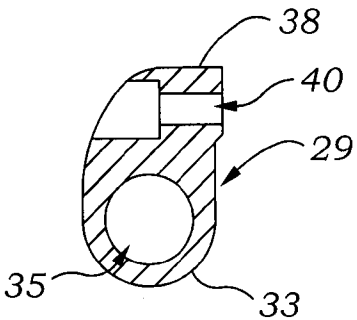
FIG. 6C is a side elevation view of the hinge coupler of FIG. 6A.

As shown in FIGS. 6B–6D, hinge coupler 29 includes a laterally symmetrically shaped body 32 which has a generally cylindrically-shaped lower bushing member 33 that fits between inner facing surfaces 34L, 34R of lugs 30L, 30R. Bushing 33 has disposed laterally through its length a bore 35 which is coaxially aligned with and rotatable with respect to a transversely disposed pivot axle 36 which is disposed through the bore and which is fixed at opposite longitudinal ends thereof in bores 37L, 37R through lugs 30L, 30R.

Figures 10A, 10B, 10C:
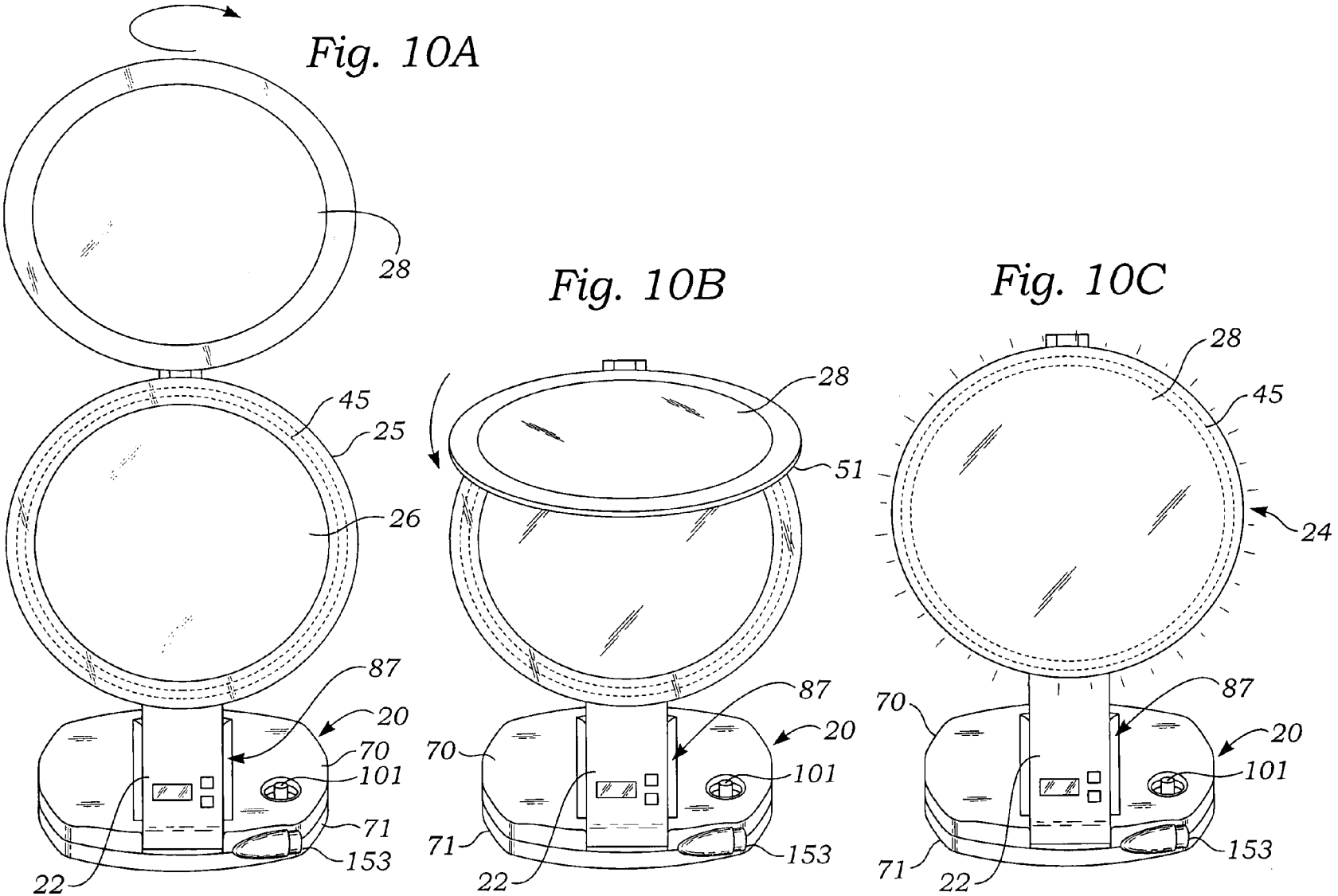
FIG. 10A is a perspective view similar to that of FIG. 8A, but showing the right-hand mirror device of FIG. 1, with the upper, secondary mirror rotated 180 degrees about a longitudinal, radially disposed swivel axis lying in a vertical medial plane of the handle.
FIG. 10B is a view similar to that of FIG. 10A, but showing the secondary mirror being pivoted downwardly about a transverse pivot axis perpendicular to the rotation axis, to thereby orient the frame side of the upper mirror next to the front surface of the lower mirror, thereby orienting the front, reflective surface of the upper mirror to a forward-facing use position.
FIG. 10C is a view similar to that of FIG. 10B but showing the secondary mirror nearly parallel to the primary mirror, and showing light emitted by an annular illuminator of the primary mirror transmitted through a light transmissive bezel ring of the secondary mirror frame to thereby illuminate an object field in front of the secondary mirror.

Body member 32 of hinge coupler 32 includes a generally rectangularly-shaped, laterally elongated boss 38 which protrudes radially outwardly from lower bushing portion 33. Boss 38 has an upper surface 39 which lies in a plane above transverse pivot axle 36 and has protruding perpendicularly downwards into upper surface 39 a swivel pin bore 40 which is disposed perpendicularly to and radially outwardly from the transverse pivot axle, midway between opposite transverse sides 41L, 41R of bushing member 33 located at opposite longitudinal ends thereof. Swivel bore 40 rotatably holds a swivel pin 42 which protrudes radially outwardly from a lower edge 43 of upper, secondary mirror frame 27. With this arrangement, secondary mirror frame 27 is pivotable above transversely disposed pivot axle 36, and swivelable in orthogonally disposed, radial swivel pin bore 40, as shown in FIGS. 8 and 10.

As shown in FIGS. 6A, 7A, 7D, 8B, and 8C, primary mirror frame 25 includes in an outer peripheral portion which borders primary mirror 26 a rearwardly or inwardly concave annular ring-shaped lamp channel 44 in which is mounted a circular ring-shaped, tubular lamp 45, which is preferably a cold-cathode, fluorescent lamp. As shown in FIGS. 6A, 8A, and 8B, lamp channel 44 has a generally flat, annular, ring-shaped cover window 46 which has light transmissive and preferably partially light-diffusive. In a preferred embodiment, primary mirror 26 has a concave, spherically-shaped reflective surface 47 which has a radius of curvature selected to yield a desired magnification factor, e.g., between about 5× and about 9×. Although the dimensions of lamp channel 44 are not critical, the radial width of the channel in an example embodiment of travel mirror 20 was about ¾ inch.

As shown in FIGS. 6A, 7A and 7B, primary mirror 26 is mounted within a rearwardly concave, generally spherically contoured cavity 48 formed in the front surface of primary mirror frame 25, concentrically located with respect to lamp channel 44, by any suitable means, such as thin strips of tape 49 coated on both sides with a pressure sensitive adhesive and located between an outer annular portion 50 of rear surface 51 of the mirror, and an annular shoulder ledge 52 which protrudes radially inwardly of the outer circumferential wall of the cavity. As shown in FIGS. 6A and 7B, shoulder ledge 52 is recessed inwardly or rearwardly of outer circumferential edge 53 of primary mirror frame 25, sufficiently far to locate the front surface 54 of primary mirror 26 inwardly or rearwardly of annular lamp channel cover window 46, thereby preventing contact between the front surface of the primary mirror with the front surface 55 of secondary mirror 28, when secondary mirror frame 27 is pivoted to overlie the primary mirror, as shown in FIG. 1.

Referring to FIG. 6A, it may be seen that secondary mirror 28 has a circular shape, and may have a spherical concave surface which has a different radius of curvature than that of primary mirror 26, but preferably has less curvature and thereby a smaller magnification factor. In a preferred embodiment, mirror 28 has an infinitely large radius of curvature, i.e., is flat, and thus has a "1×" or unity magnification factor.

As shown in FIGS. 6A, 7E, 7F, and 11, secondary mirror frame 27 has a shape approximating that of a thin circular plate which has a flat front surface 56 and a convex, arcuately curved rear surface 57 which has a slight curvature. Front surface 56 of secondary mirror frame 27 has formed therein a concentric, circular shallow recess 58 which has a circular bottom wall 59 and a cylindrically shaped peripheral wall 60. Recess 58 has an outer circumference 61 sufficiently smaller than that of the outer circumferential edge 62 of secondary mirror frame 27 to form therebetween an annular ring-shaped bezel 63 which has a radial width approximately equal to or slightly less than that of annular ring-shaped cover window 46 of primary mirror frame 25, e.g., about ⅝ inch. According to the invention, at least bezel portion 63 of secondary mirror frame 27 is made of a light transmissive material. In a preferred embodiment, frame 27 is fabricated as a unitary molded part from a transparent material such as a polycarbonate or acrylic polymer plastic.

Secondary mirror 28 is retained within recess 58 of frame 27 by any suitable means, such as pressure sensitive adhesive 64 between rear surface 65 of the secondary mirror and upper surface 66 of bottom wall 59 of the recess.

Referring to FIGS. 6A, 7E, and 7F, it may be seen that secondary mirror frame 27 has a sector-shaped notch formed in outer circumferential edge 62 thereof, thereby forming a straight edge wall 67 lying along a chord of the outer circumferential edge, the edge wall being bisected by a radius of the frame. Chordal edge wall 67 of secondary frame 27 has a flat outer peripheral surface 68 which is perpendicular to flat front surface 56 of the frame, and has protruding radially inwardly therefrom a tapered bore 69 in which is fixed swivel pin 42. As explained above, the outwardly protruding, lower portion 42 of swivel pin 42 is rotatably held within swivel bore 40 of hinge coupler 29.

Figure 5:
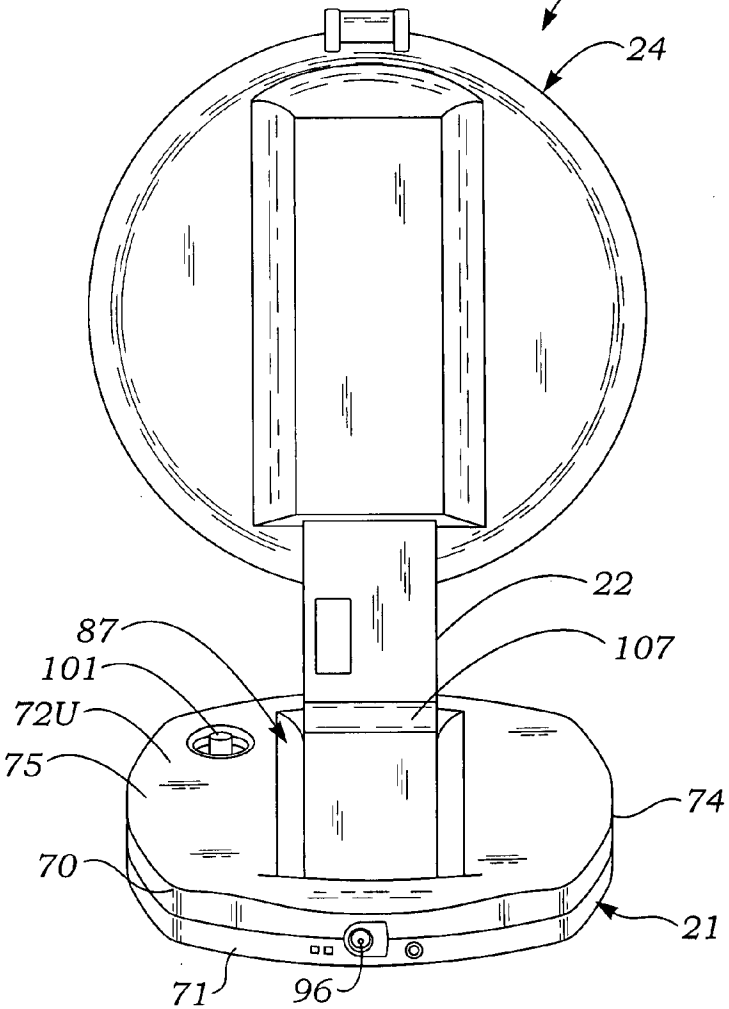
FIG. 5 is a rear perspective view of the arrangement of FIG. 4.
Figure 4:
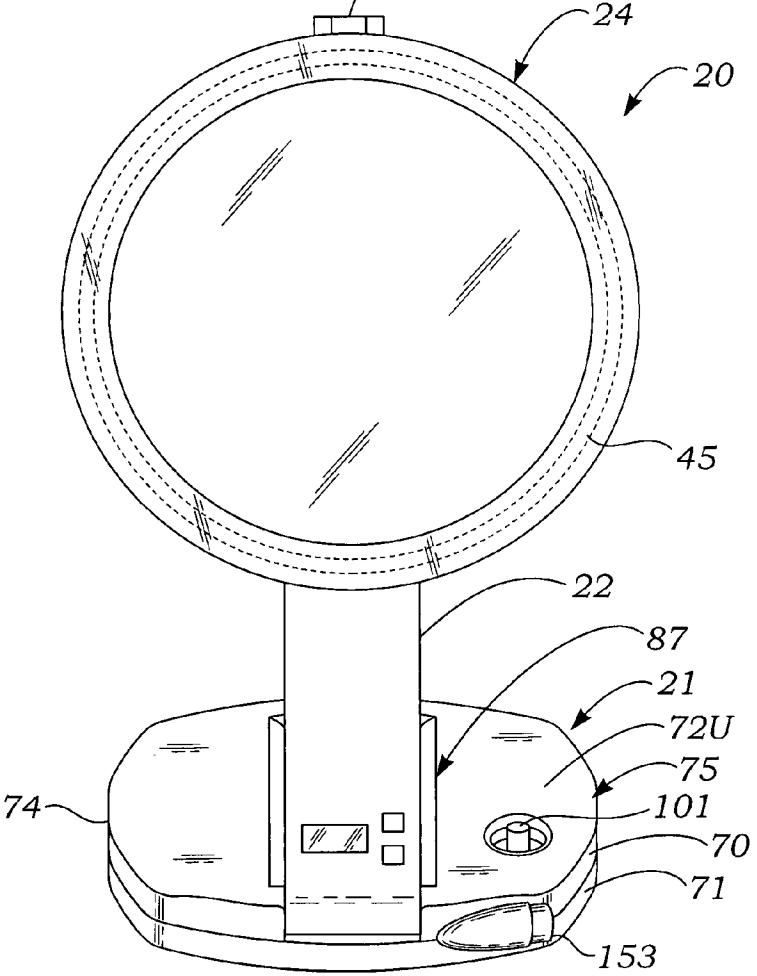
FIG. 4 is a front perspective view similar to that of FIG. 1E, but showing the handle of the device pivoted fully upwards from the base, and the dual mirror assembly telescopically extended to its maximum height.

FIGS. 1A–21 4,5 and 9–14 illustrate details of base 21, handle 22, and handle pivot joint 23 of travel mirror 20 according to the present invention. As shown in those figures, base 21 preferably includes an upper upwardly concave base half shell 70, and a lower 27 downwardly concave base half shell 71, each of which has in plan view a longitudinally elongated oblong shape with arcuately curved transverse end walls. Thus, upper half shell 70 has an upper wall 72 which has protruding downwardly therefrom a flange wall 73 which includes straight left and right parallel longitudinally disposed side wall segments 74, 75 and front and rear convex arcuately curved transverse end wall segments 76, 77, respectively, which are each symmetrically shaped about a longitudinal vertical center plane of the base, and symmetrically shaped with respect to one another through a transversely disposed central mirror plane of the base. Similarly, lower base half shell 71 has a lower base wall 82 which has protruding upwardly therefrom a flange wall 83 which includes straight left and right parallel longitudinally disposed side wall segments 84, 85 and front and rear convex arcuately curved transverse end wall segments 86, 87, respectively, which are each symmetrically shaped about a longitudinal vertical center plane of the base, and symmetrically shaped with respect to one another through a transversely disposed central plane of the base. As shown in FIGS. 5 and 6E, upper half shell 70 has formed in upper surface 72U of upper wall 72 thereof a relatively wide, longitudinally elongated rectangularly-shaped handle groove 87 located centrally between left and right side walls 74, 75 of the upper half shell.

Referring now to FIGS. 9–14, it may be seen that upper and lower half shells 70, 71 have inner concave spaces 90, 91, respectively, which, when the half shells are fastened together, form an elongated hollow interior space 92. Concave inner space 90 of upper half shell 70 contains a battery compartment 93 which is adapted to hold four AA dry cells connected in series with a pair of positive and negative output lead wires 94, 95 which are connected in parallel with a battery eliminator jack 96 mounted in a vertically opposed pair of upper and lower slots 97, 98 of upper and lower half shells 70, 71, the jack protruding rearward through upper and lower U-shaped half apertures 99, 100 in rear transverse end walls 77, 87, respectively, of the upper and lower half shells. Positive and negative output lead wires 94, 95 are also connected through a switch 101 to power input terminals of a d.c.-a.c. inverter 102, which has a pair of high-voltage a.c. output lead wires 103, 104 which thread through the bore 105 of a diametrically split axle bushing 106 located at a transverse end of a handle pivot axle 107 located at the lower end of handle 22, and thence to electrodes 108, 109 of lamp 45.

Figure 2:
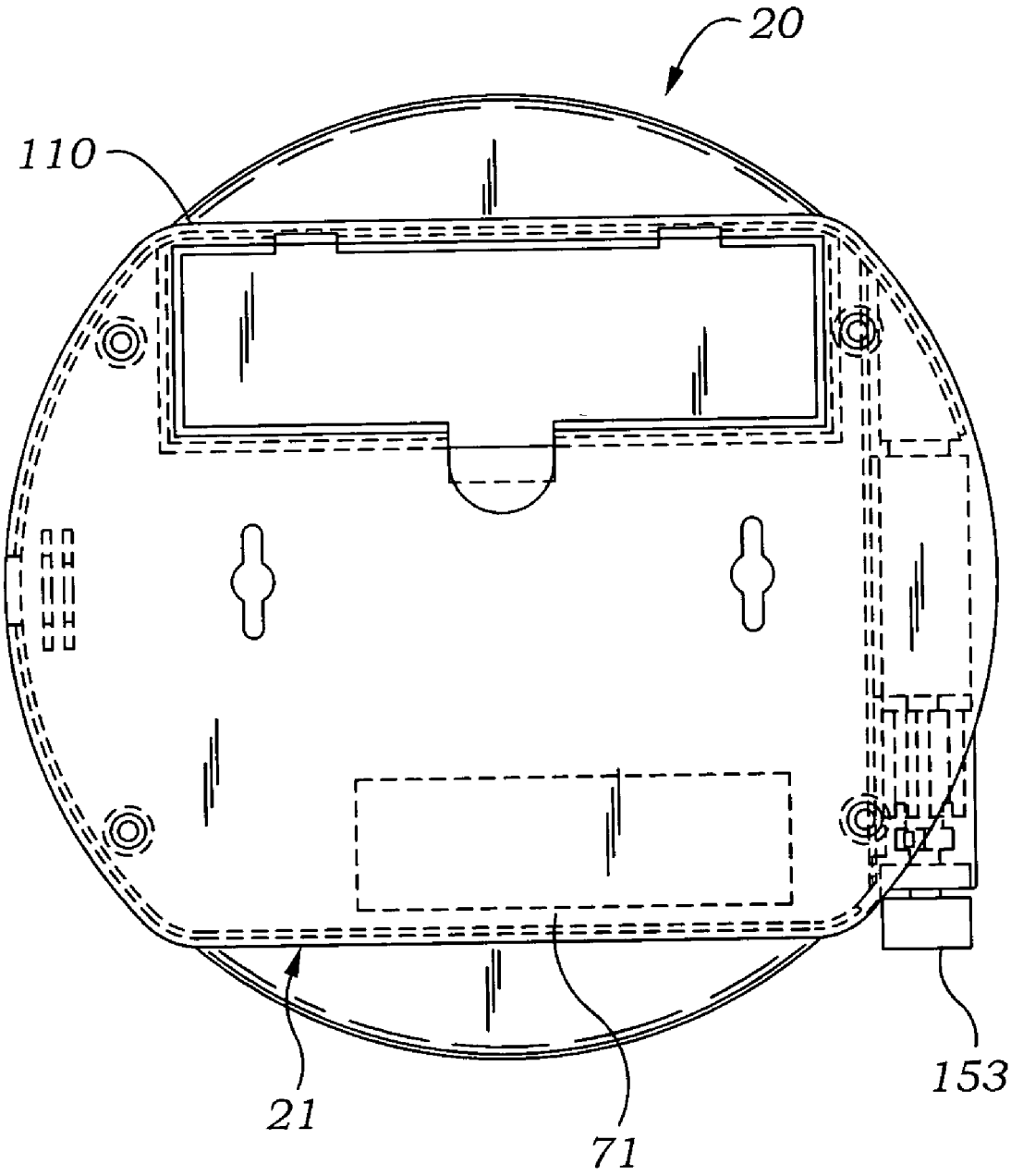
FIG. 2 is a lower plan view of the travel mirror of FIG. 1.
Figure 3A:
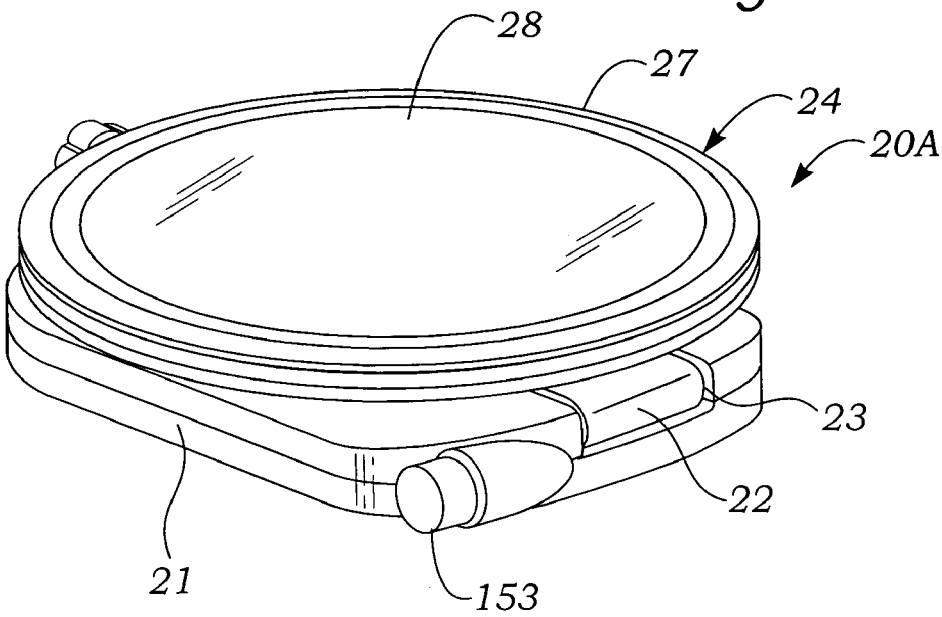
FIG. 3A is a perspective view of a left-handed modification of the travel mirror of FIG. 1.
Figure 3B:
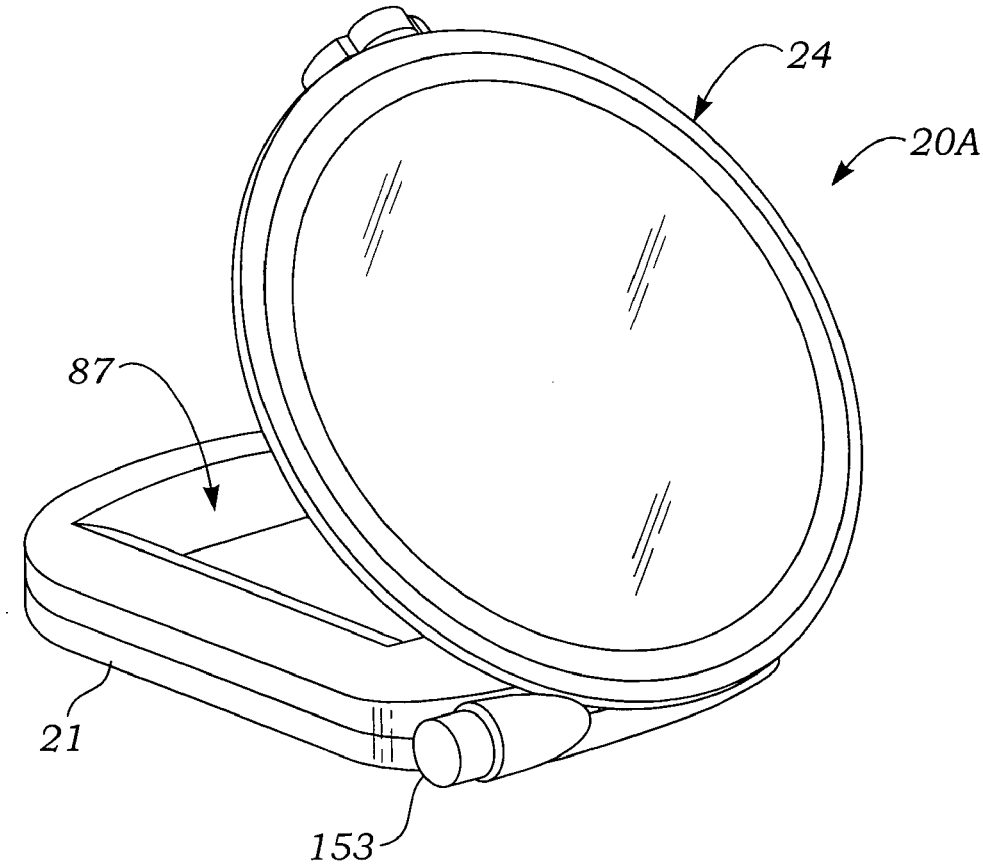
FIG. 3B is a perspective view of the travel mirror of FIG. 3A, showing a dual mirror assembly and handle portion of the device pivoted upwardly from a base part of the device.
Figure 12A:
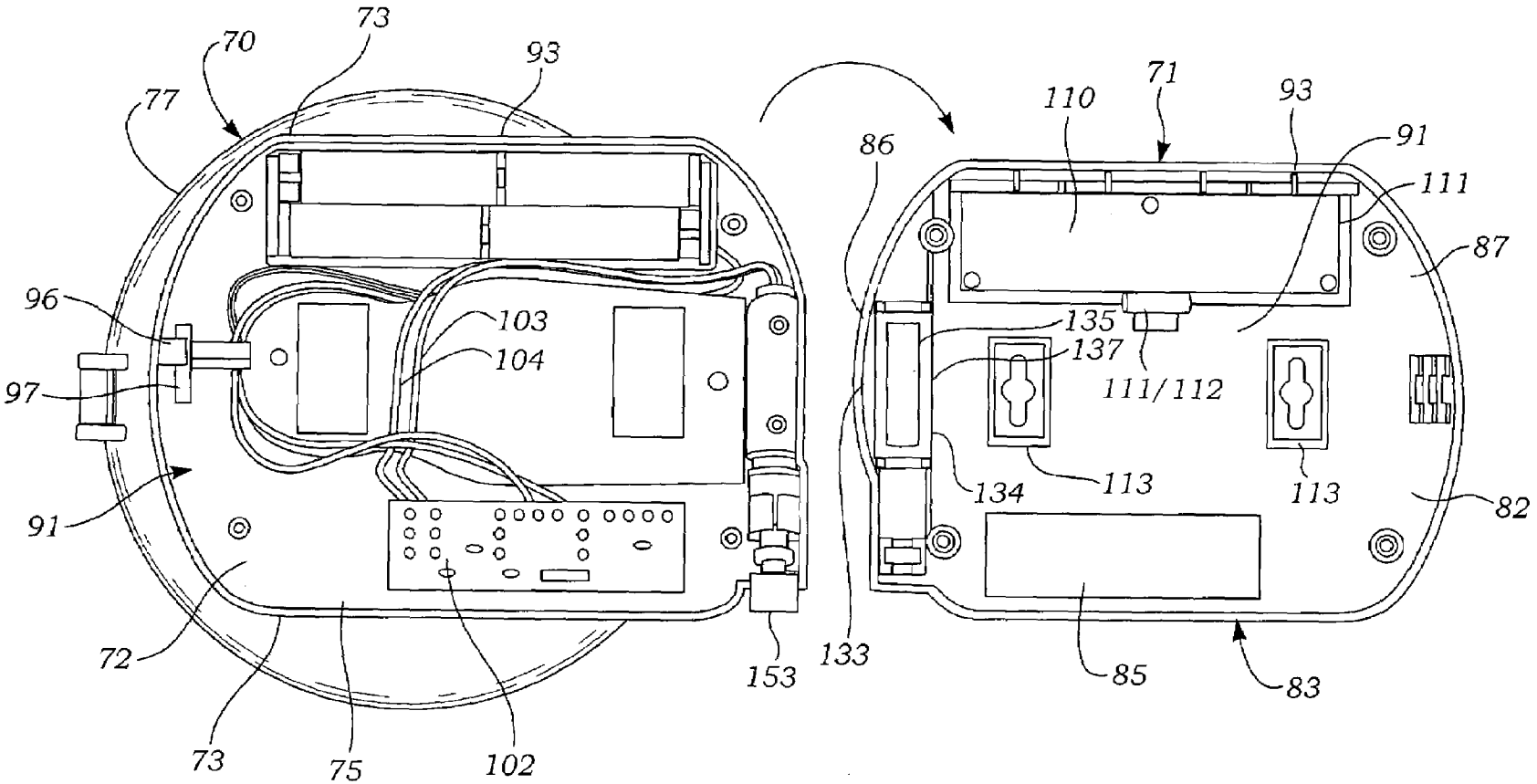
FIG. 12A is an exploded lower perspective view of the mirror device of FIGS. 1A and 2, showing an upper half shell portion of the base removed from a lower half shell portion and inverted.
Figure 12B:
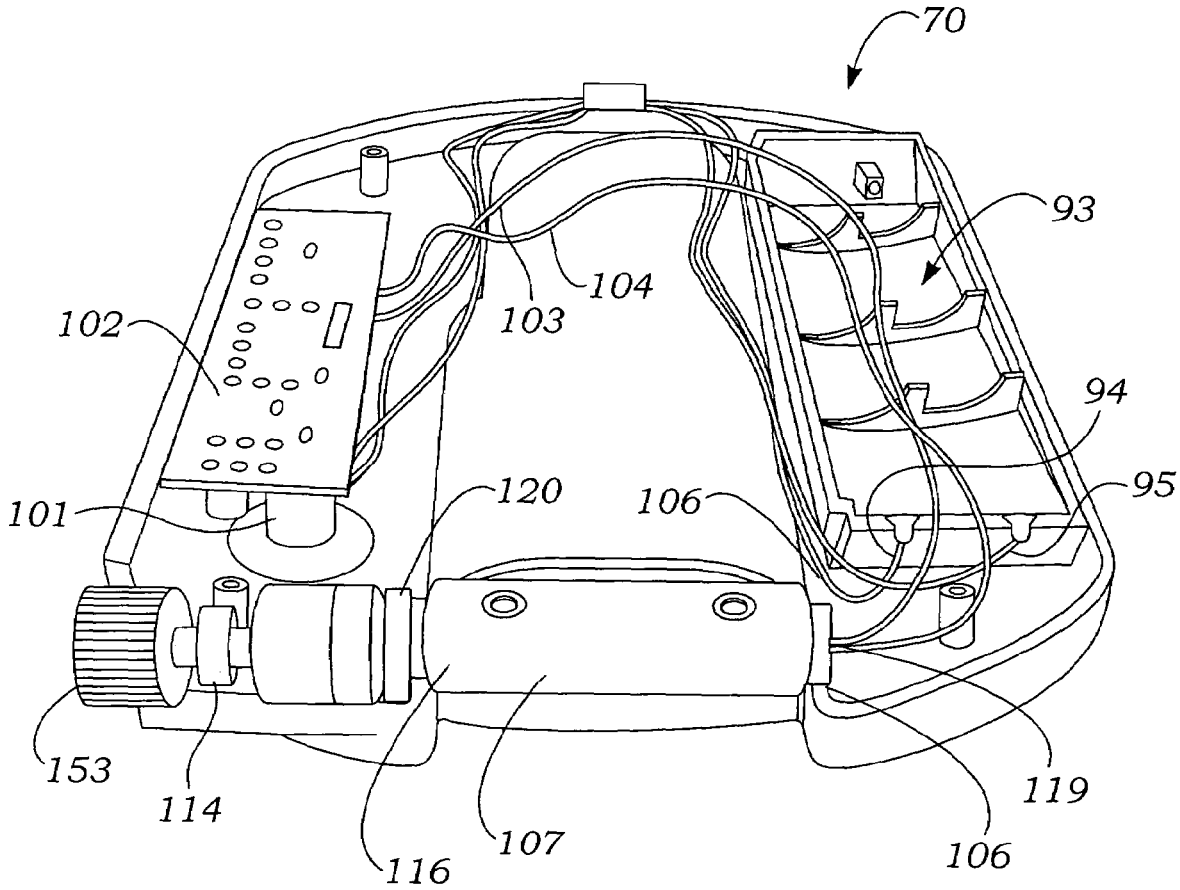
FIG. 12B is an enlarged lower view of the upper half shell portion of the base shown in FIG. 12A.
Figure 12E:
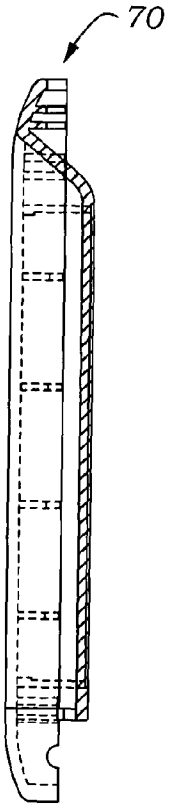
FIG. 12E is a longitudinal sectional view of the upper base half-shell of FIG. 12C.
Figure 12C:
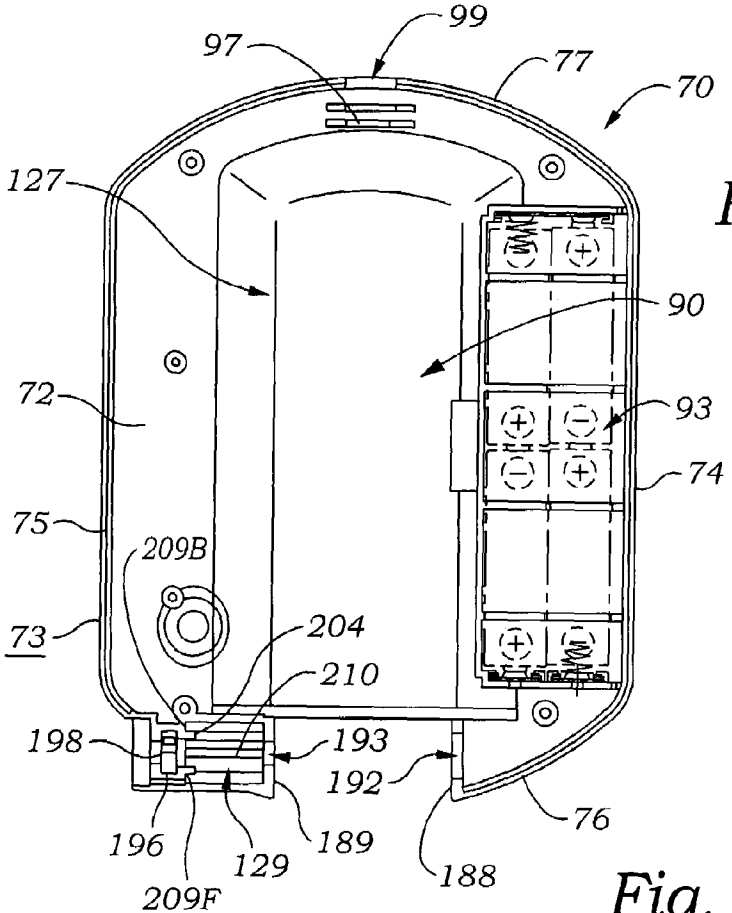
FIG. 12C is a fragmentary lower plan view of the upper half-shell portion of the base of FIG. 12B, showing circuitry thereof removed.
Figure 12D:
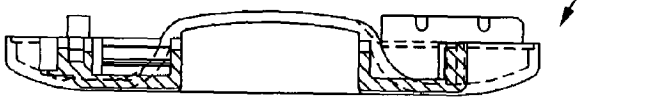
FIG. 12D is a transverse sectional view of the upper base half-shell of FIG. 12C.
Figure 12F:
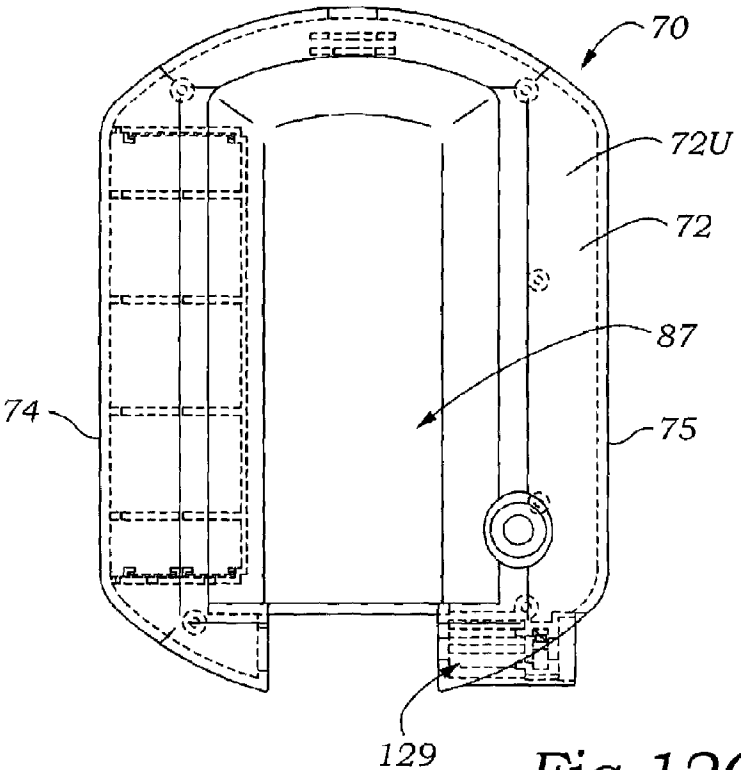
FIG. 12F is an upper plan view of the upper base half-shell of FIG. 12C.
Figure 12G:
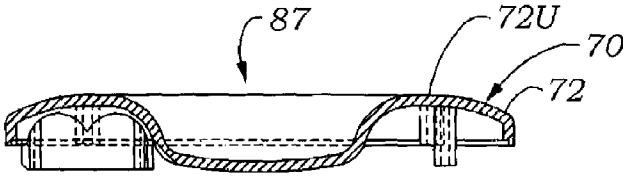
FIG. 12G is a transverse sectional view of the upper base half-shell of FIG. 12F.
Figure 12J:
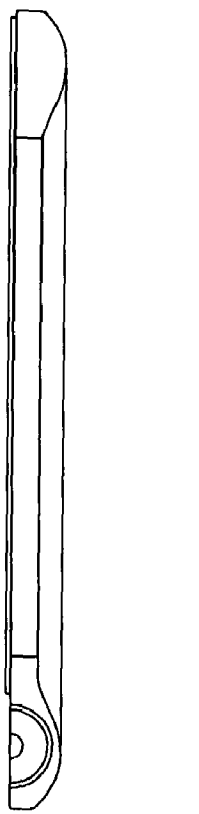
FIG. 12J is a side elevation viewe of the lower base half-shell of FIG. 12H.

As shown in FIGS. 2 and 12A, bottom half shell 71 of base 21 has a longitudinally disposed battery compartment access door 110 frictionally held within a longitudinally elongated, rectangularly shaped battery compartment access port 111 by a resilient plastic folded leaf-shaped self-spring latch 112 molded integrally with the access door, which is vertically aligned with battery compartment 93. Preferably, base wall 82 of lower half shell 71 also has through its thickness dimension a pair of longitudinally spaced apart, front and rear laterally disposed mounting holes 113F, 113B which each have generally circularly shaped center portion 114 and a pair of diametrically opposed radially outwardly protruding, mirror symmetric slots 115 for slidably receiving the shank of mounting screw (not shown) screwed into a wall which has a head (not shown) insertable into the center portion of the mounting holes, thereby enabling travel mirror 20 to be removably mounted onto a wall by a pair of vertically disposed screws.

Referring to FIGS. 12A-14, it may be seen that handle pivot axle 107 located at a lower end portion of handle 22 has a generally cylindrical shaped major body portion 116 which is disposed transversely between opposite left and right vertical sides 117L, 117R of the handle. Pivot axle 107 includes at one side of, e.g., the left side, a bushing 106 of smaller diameter than body 116 of the axle which protrudes axially, i.e., perpendicularly outwards from left transverse face end 119 of the axle body. Also, pivot axle 107 has protruding from an opposite, e.g., right transverse side thereof, a cylindrically shaped boss section 120 which has a diameter approximating that of main axle body 116. Cylindrical boss section 120 of axle 107 has formed in outer cylindrical wall surface 121 thereof a rectangular cross-section, circumferential annular groove 122, an inner transverse end wall 123 of which is located adjacent to right vertical side wall 117R of the handle. Boss section 120 also has a cylindrically shaped axially outwardly located end portion 124 which extends from an outer transverse end wall 125 of groove 122. Outer cylindrical end portion 124 of right-hand cylindrical boss section 120 of handle pivot axle 107 has a transversely disposed, outer circular end face 125, which has protruding perpendicularly outwards therefrom a concentrically located stud 126 which has a generally rectangular transverse cross section.

Figure 11:
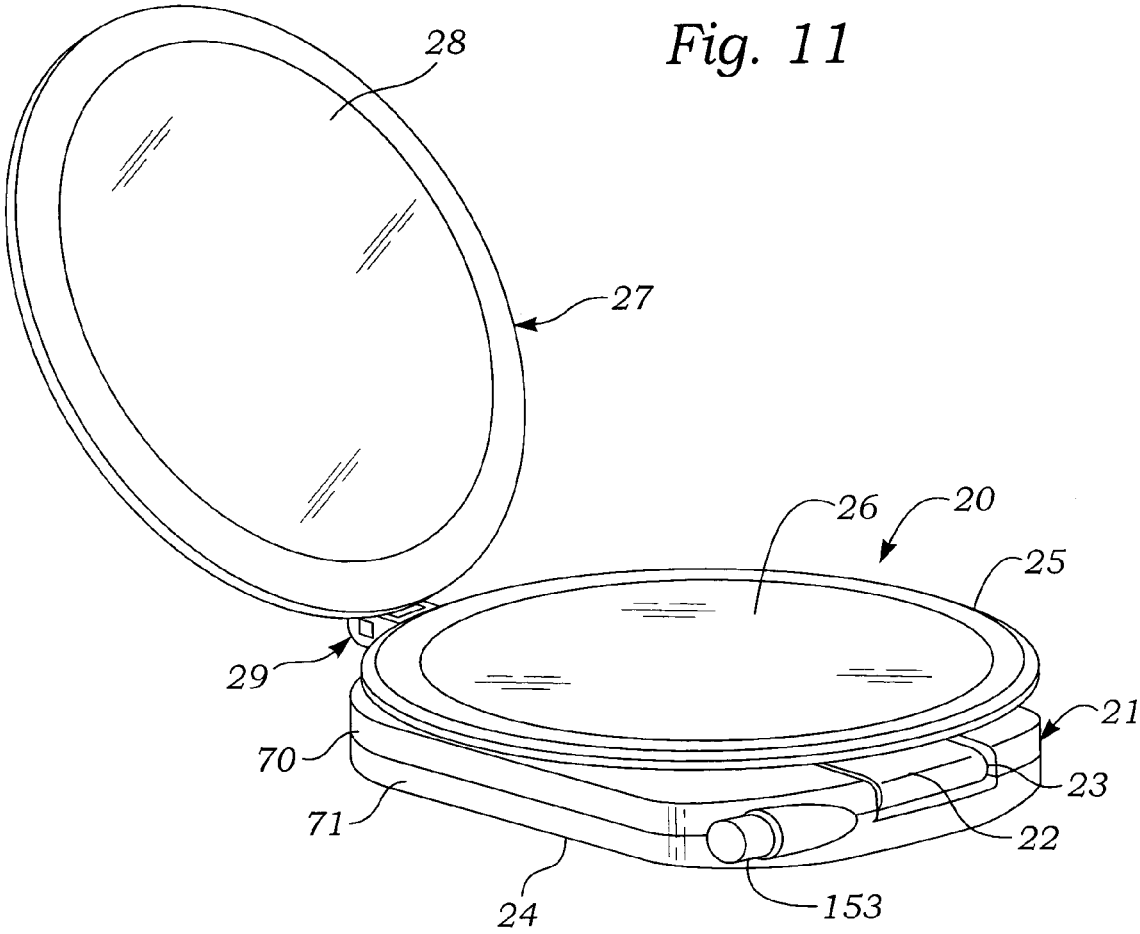
FIG. 11 is a left side perspective view of the left-hand mirror device of FIG. 3, showing the dual mirror assembly thereof telescopically retracted on the handle towards the base of the device, and showing the upper mirror of the dual mirror assembly pivoted upwardly and rotated to orient the reflective surface of the upper mirror to a forward use position.

Referring still to FIGS. 12A-14, it may be seen that upper and lower base half shells 70, 71 have formed in front portions of inner opposed concave faces 127, 128 thereof transversely disposed, generally semi-cylindrically shaped upper and lower grooves or channels 129, 130, respectively, which, when the half shells are secured together, form a generally cylindrically-shaped cavity 131 for rotatably receiving cylindrically-shaped handle pivot axle 107. Thus, as shown in FIGS. 9–11, lower base half shell 71 has protruding upwardly from lower base wall 82 thereof a laterally centrally located, generally semi-cylindrically-shaped pivot axle groove 132 which has a front upper wall 133 adjacent to front transverse end wall 86 of the base shell. Pivot axle groove 132 has a rear edge wall comprised of a thin, arcuately curved web 134 which protrudes upwardly from the upper surface 135 of lower base wall 82, and a lower wall surface 135 comprised of a semi-cylindrically contoured groove formed in the upper surface of the lower base half shell. As shown in FIG. 12H, lower curved wall surface 135 of semi-cylindrical pivot axle groove 132 preferably has protruding downwardly therefrom a laterally elongated, rectangularly-shaped shallow recess 136 in which is mounted a rectangularly-shaped friction pad 137 that is made of a material such as silicone rubber which has a relatively large surface coefficient of sliding friction.

Figure 12H:
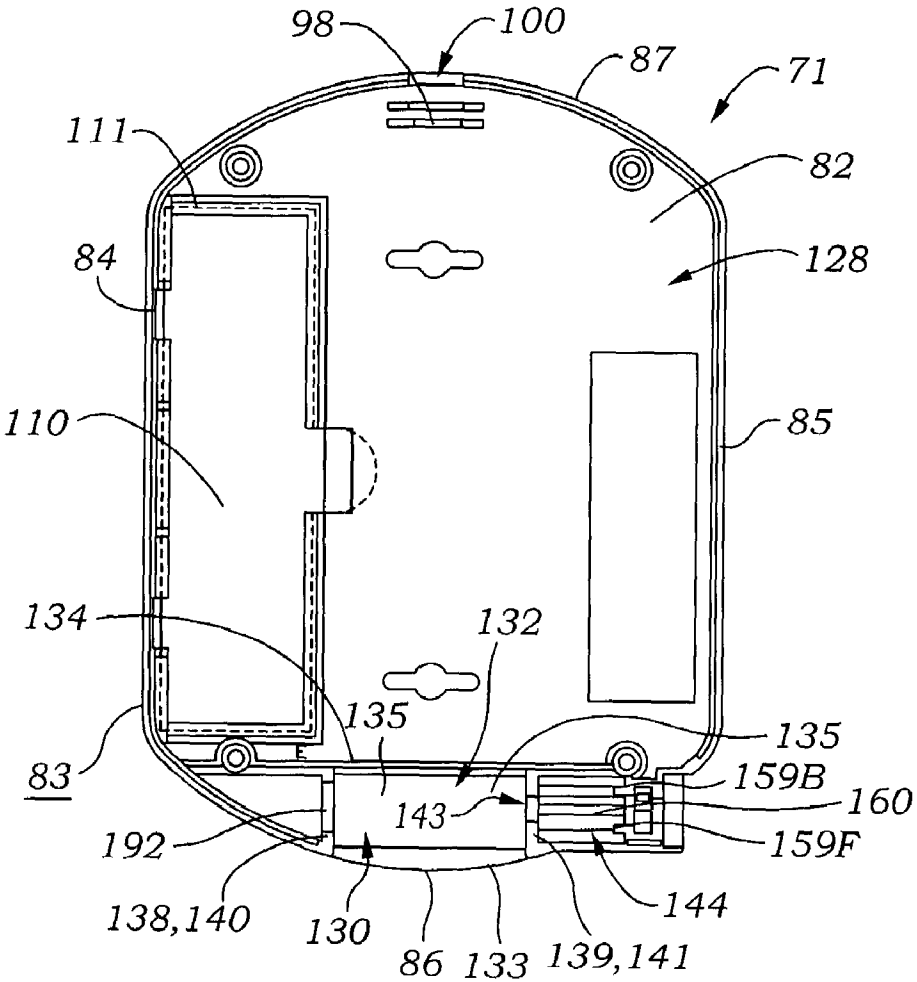
FIG. 12H is an upper plan view of the lower base half-shell of FIG. 12A, on a somewhat larger scale.

As shown in FIGS. 12H, pivot axle groove 132 has left and right U-shaped, transverse end journals 138, 139 located at left and right ends thereof, respectively, of the groove. The end journals 138, 139 are comprised of generally uniform-thickness, transversely disposed U-shaped webs 140, 141 which protrude perpendicularly upwards from upper surface 135 of lower base wall 82 of lower half shell 71. Left and right end journals 138, 139 have formed in upper surfaces thereof left and right downwardly concave semi-cylindrically-shaped grooves 142, 143 which are of a suitable size and lateral spacing from one another to rotatably receive the left-hand bushing 106 and right-had groove 122 of right-hand cylindrical boss section 120, respectively, of handle pivot axle body 116.

As is also shown in FIG. 12H, lower base half shell 71 also includes a generally semi-cylindrically shaped, axial friction control groove 144 which is adjacent to the outer, right-hand transverse face 145 of right-hand handle pivot axle body journal 139. Friction control groove 144 is coaxially aligned with lower semi-cylindrical pivot axle groove 132, and preferably of smaller diameter and length. Also, friction control groove 144 has located at a right transverse end thereof a short semi-cylindrically shaped nut holder groove 146 which has a polygonal transverse cross-section and which is adapted to irrotatably hold a hex nut 147. Nut holder groove 146 has an outer, right-hand transverse end journal 148 which has the form of a U-shaped web 149 that has in an upper surface thereof a groove 150 adapted to rotatably receive the shank 151 of a friction adjustment screw 152 which has located at the outer end thereof, a fluted friction-adjustment knob 153. Also, the inner, left-hand transverse end of nut holder groove 146 is bordered by a U-shaped left-hand end journal 154 comprised of U-shaped web 155 which protrudes upwardly from upper surface 135 of lower base wall 82 of lower half shell 71. Left-hand nut groove journal 154 has formed in upper surface 156 of web 155 thereof a downwardly concave semi-cylindrically shaped groove 157 which is of a suitable size to provide clearance for and therefore allow free rotation of screw shank 151.

Referring still to FIG. 12H it may be seen that outer, left-hand transverse face 158 of left-hand nut groove journal 154 has protruding axially outwards therefrom a pair of generally rectangularly-shaped, vertically disposed front and rear end spacer ribs 159F, 159B, which are spaced equal distances radially outwards from front and rear sides of journal groove 157. Outer, left-hand face 158 of left-hand nut groove journal 158 also has protruding axially outwards from a lower base portion thereof a low, rectangular cross-section, slider rib 160 which protrudes upwardly from the center of lower semi-cylindrical wall surface 161 of friction control groove 144. As shown in FIGS. 9 and 10, slider rib 160 protrudes upwardly into a longitudinally disposed lower groove 162L formed in the outer cylindrical surface 163 of a cylindrically-shaped slider bushing 165 which is longitudinally slidably located in axial friction control groove 144.

As shown in FIGS. 12A–14, slider bushing 165 has formed in outer cylindrical surface 163 thereof upper and lower longitudinally disposed, diametrically opposed, rectangular cross-section grooves 162U, 162L, respectively. Slider bushing 165 has a transversely disposed circular, flat outer or right-hand end face 166, and a circular left-hand transverse face in which are formed axially inwardly protruding rectangular cross-section vertically disposed transverse grooves 167U, 167L which are continuous with upper and lower longitudinal grooves 162U, 162L, and a pair of radially disposed front and rear transverse grooves 168F, 168B which are perpendicular to the vertically disposed grooves. All of the above-identified end face grooves radiate from a coaxially centrally located blind bore 169 which protrudes inwardly from outer, left-hand transverse face 170 of slider bushing 165. Bore 169 is provided for receiving stud 126 which protrudes outwardly from boss 120 of handle pivot axle 107. The function of end face grooves 167U, 167L, 168F, 168B is to facilitate elastic deformation of bushing 165 in response to longitudinal forces exerted on the bushing.

As shown in FIGS. 12A–14, friction control groove 144 longitudinally slidably holds in axial alignment with slider bushing 165 a circular rubber washer 171, which is preferably sandwiched between a pair of outer and inner circular plastic washers 172O, 172I, all of which have a diameter approximating that of the slider bushing and slightly less than that of the friction control groove. Each of the washers is provided with central coaxial through-bore. The inner transverse face 173I of inner plastic washer 172I adjacent to outer circular end face 126 of right-hand cylindrical boss section 120 of handle pivot axle 107 is pressed against the right-hand end face of the handle axle boss section with an axial force which is adjustable by turning friction control knob 153. Turning friction control knob 153 in a direction which advances friction adjustment screw shank 151 towards the handle pivot axle increases the axial frictional force exerted on the pivot axle to resist pivotable motion of the handle relative to the base; turning the control knob in the opposite direction retracts the screw shank to thereby reduce frictional resistance to pivotable motion of the handle.

Referring to FIGS. 12A–14, it may be seen that upper base half shell 70 has formed therein an upwardly concave generally semi-cylindrically shaped, transversely disposed upper half shell channel 129 that has several structural elements which have shapes complementary to those of elements of the lower half shell which were identified and described above. Those upper and lower structural elements are mirror symmetrical through a horizontally disposed joint plane between upper and lower base half shells 70, 71 and cooperate to form generally cylindrically shaped cavities. Thus, for example, upper base half shell 70 has left and right transverse end journals 188, 189, which mate with lower base half shell journals 138, 139, the semi-cylindrically shaped grooves 142, 143 of the lower journals mating with semi-cylindrically shaped grooves 192, 193 of the upper half shell journals to form closed, cylindrically shaped pivot axle body end journals 292, 293, respectively. Similarly, upper base half shell 70 has formed therein an upper semi-cylindrically shaped friction control groove 194 which forms with lower semi-cylindrically shaped friction control groove 144 of lower base half shell 71 a cylindrically shaped friction control cavity 293. Upper base half shell 70 also includes a semi-cylindrically shaped upper nut holder groove 196 which is bordered on right and left ends thereof by right and left upper nut groove journals 198, 204, forming with corresponding lower right and left journals 148, 154, respectively, a closed, cylindrically shaped nut holder cavity 296.

Referring still to FIGS. 12A–14, it may be seen that upper base half shell 70 has protruding downwardly from the upper inner surface thereof spacer ribs 209F, 209B and a slider rib 210 which are mirror images of ribs 159F, 159B, and 160, respectively, of lower base half shell 71.

Figure 14:
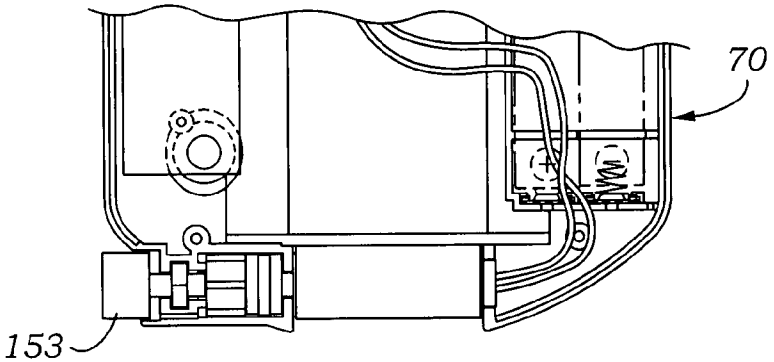
FIG. 14 is a view similar to that of FIG. 13, showing the handle portion of the device pivoted away from the base.
Figure 13:
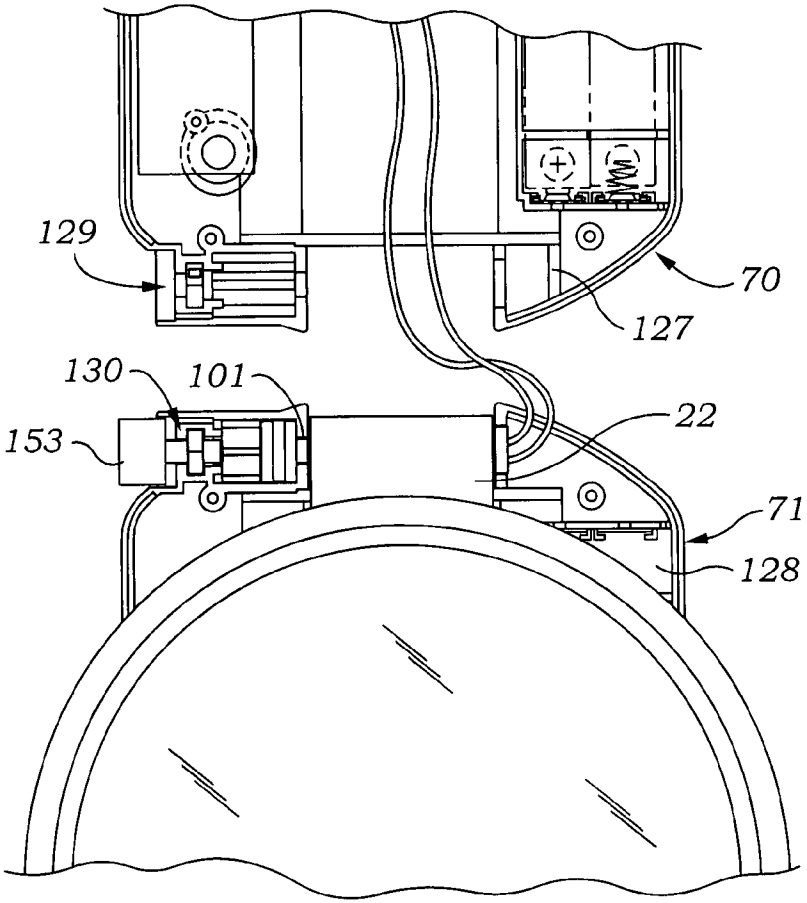
FIG. 13 is an enlarged view of the mirror frame and handle assembly and the lower shell portion of the base shown in FIG. 12A, and showing handle-pivot friction control elements transferred from upper half shell grooves to lower half shell grooves, the mirror frame fully extended, and the secondary mirror swiveled into a use position overlying the primary mirror.
Figures 17, 17A, 17B, 17C, 17D:
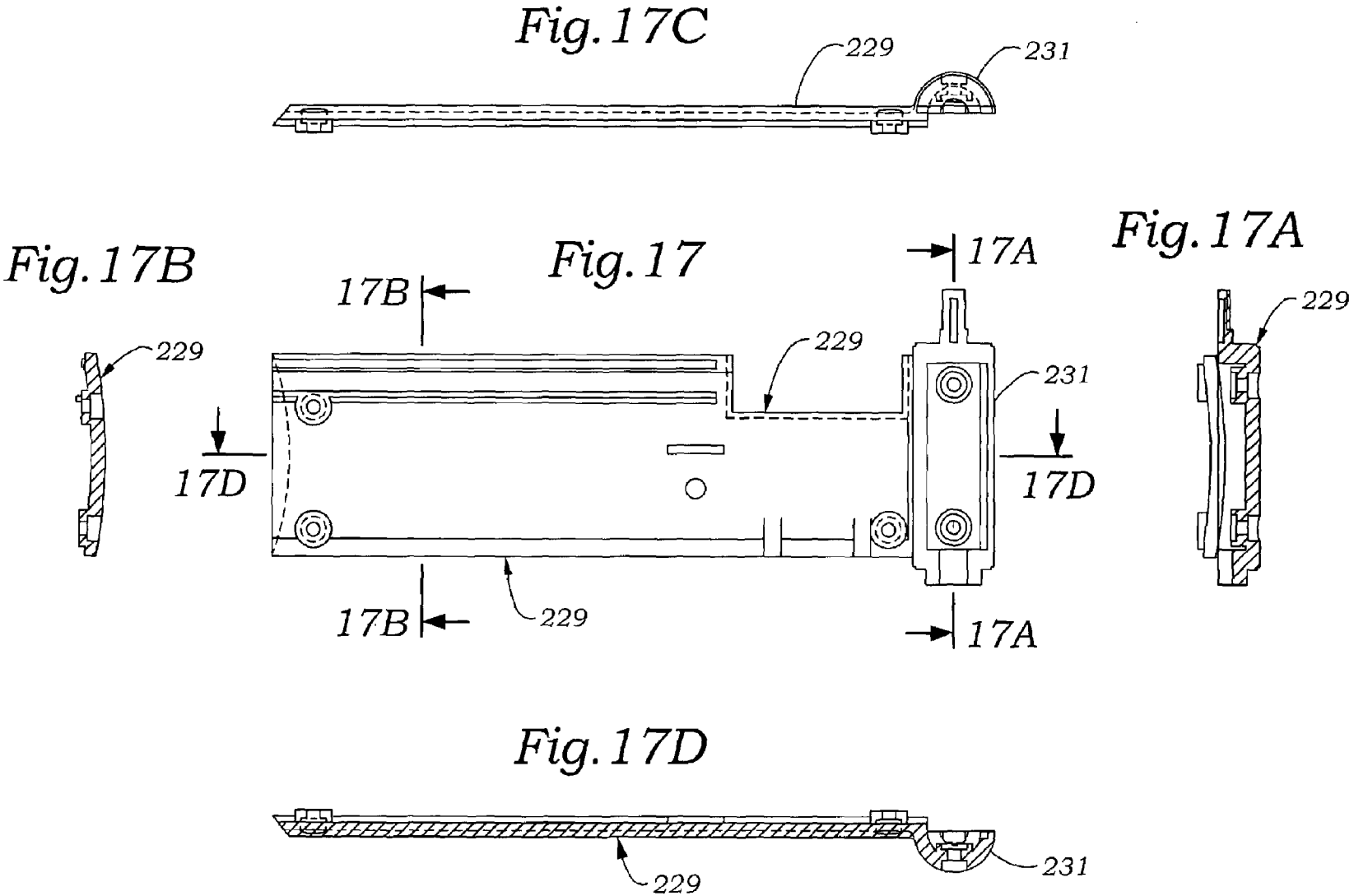
FIG. 17 is a rear elevation view of a rear cover portion of the handle of the mirror of FIG. 1.
FIG. 17A is a transverse vertical sectional view of the rear handle cover of FIG. 17, taken in the direction of line 17A—17A.
FIG. 17B is a transverse vertical sectional view of the rear handle cover of FIG. 17, taken in the direction of line 17B—17B.
FIG. 17C is a side elevation view of the rear handle cover of FIG. 17.
FIG. 17D is a longitudinal sectional view of the rear handle cover of FIG. 17, taken in the direction of line 17D—17D.
Figure 21:
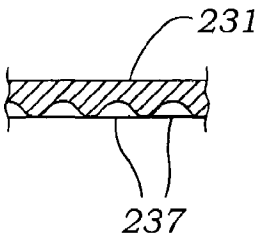
FIG. 21 is an enlarged fragmentary view of the detent plate of FIG. 20.
Figure 19:
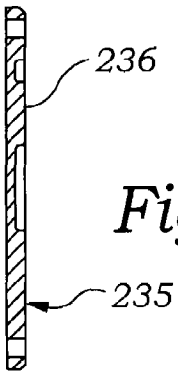
FIG. 19 is a transverse sectional view of the detent plate of FIG. 17.
Figure 20:
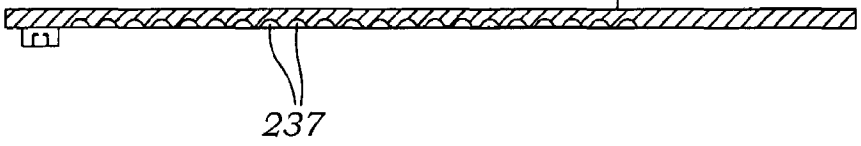
FIG. 20 is a longitudinal sectional view of the retainer detent plate of FIG. 18.
Figure 18:
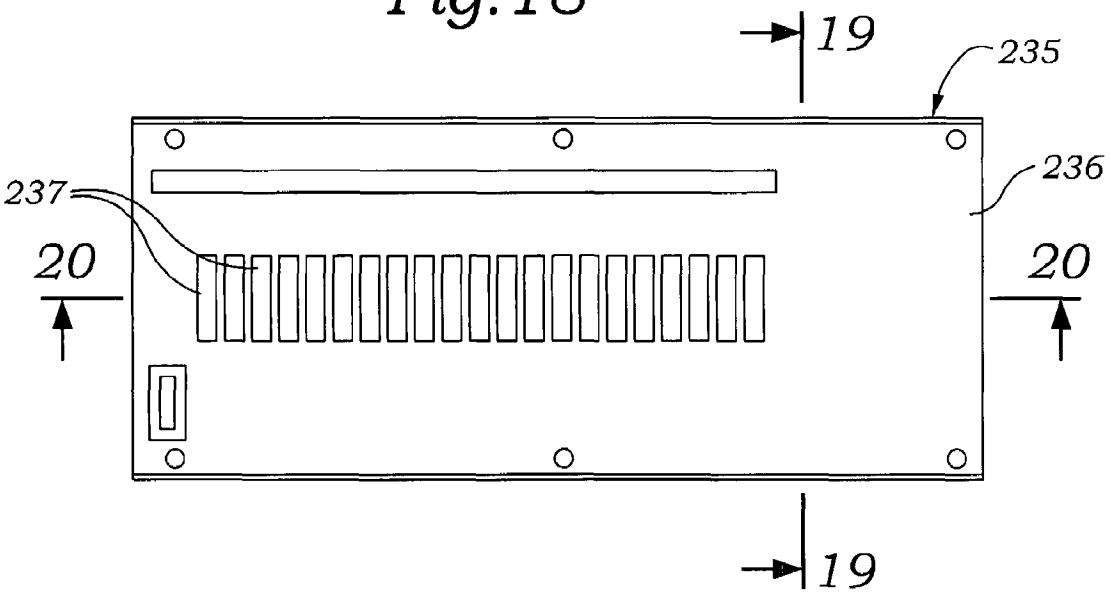
FIG. 18 is a rear elevation view of a handle retainer detent plate which mounts in the primary mirror frame of FIG. 7.

As shown in FIGS. 12A–14, upper base half shell 70 has protruding rearwardly from front edge wall 221 thereof an elongated, rectangularly-shaped notch 222 which is laterally symmetrically located with respect to the left and right side walls 223L, 223R of the upper half shell. With upper and lower base half shells 70, 71 fastened together, notch 222 is vertically aligned with semi-cylindrically shaped pivot axle groove 132, and enables handle pivot axle 107 to rotate from an angular orientation in which handle 22 is received in handle groove 87 in the upper surface of the upper half shell, in a compact storage/transit configuration, to an upright use configuration in which the handle is angled upwardly from base 21, as shown in FIGS. 11 and 14.

FIGS. 15A through 21 illustrate structural elements of mirror device 20 which enable telescopic adjustment of dual mirror assembly 24 of mirror device 20 to a desired height relative to base 21. As shown in those figures, handle 22 of mirror 20 has a vertically elongated, generally rectangular plan-view front portion 224 which has a shape approximating that of rectangular cross-section channel member or shell which includes a front vertically elongated rectangular front base plate member 225, and rearwardly protruding left and right flange walls 226L, 226R. Front handle portion 224 has a rearwardly curved, transversely disposed lower end portion 227 which is coextensive with front, upper half 228 of handle pivot axle 107. Also, handle 22 has a rear rectangular plate-shaped panel 229 which is secured within a longitudinally disposed channel 230 in the rear side of front handle shell 224, and has located at a lower end thereof a transversely disposed, generally semi-cylindrically shaped extension 231 which mates with semi-cylindrically shaped lower end 227 of front handle shell 224 to form cylindrically-shaped handle pivot axle 107. Handle 22 fits telescopically slidably within an elongated rectangular bore 232 within an elongated generally rectangularly-shaped handle boss tube 233 which protrudes rearwardly from rear surface 234 of primary mirror frame 25, the handle boss extending vertically along a diameter of the mirror frame, centered on a diameter thereof.

As shown in FIGS. 6A, 7A–7D and 15–19, bore 232 of handle boss tube 231 has mounted in a front or bottom longitudinally disposed base wall thereof a generally rectangularly-shaped, longitudinally elongated detent plate 235. Detent plate 235 has located in rear surface 236 thereof a plurality of a longitudinally spaced apart, laterally disposed detent grooves 237. As is also shown in FIGS. 15A and 16, front base plate member 225 of front handle shell 224 has an upper transversely disposed edge wall 238 which has protruding perpendicularly inwardly therefrom a pair of parallel, longitudinally disposed left and right slots 239L, 239R which are spaced equal distances to the left and right, respectively, of a longitudinally center plane of the handle shell. Slots 239L, 239R form therebetween a rectangularly-shaped tab 240, which is flexibly and resiliently joined at a rear transverse edge 241 thereof to a longitudinally inwardly located portion of the front base wall plate 225 by an elastically deformable self hinge 242, resulting from front wall plate 225 being made of an elastically deformable polymer such as polypropylene. Tab 240 has protruding downwardly or forwardly from a front edge wall 243 thereof a laterally disposed, radiused detent rib 244. Detent rib 244 is of the proper size and shape to snap resiliently into a particular one of detent grooves 237 that it becomes aligned with as primary mirror frame 25 is moved longitudinally with respect to handle 22. With rib 244 resiliently engaged within a detent groove 237, a relatively large longitudinal force must be exerted on handle 22 relative to primary mirror frame 25 to disengage the rib from the groove. Thus constructed, primary mirror frame 25 is telescopically extendible and retractable with respect to handle 22, to an adjustable length or height relative to base 22, the adjusted height being maintained by cooperative action of the detent rib and a detent groove.

What is claimed is:

1. An illuminated travel mirror comprising;

a. a base, an elongated handle which has a lower end pivotably mounted to said base by a handle joint, a dual mirror assembly telescopically mounted to an upper end of said handle assembly and which includes a first, primary mirror frame which holds a circular primary mirror that is effective in producing reflected images having a first magnification factor and an annular ring-shaped peripheral illumination source that at least partially circumscribes said primary mirror, a secondary, upper mirror frame which is pivotably connected by a hinge coupler to an upper part of said primary mirror frame at a location opposite to said end joined to said handle and which includes a second, secondary mirror having a different magnification factor than that of said primary mirror and which is circumscribed by a light transmissive peripheral frame portion or bezel, said hinge coupler connecting said secondary frame to said primary frame being so constructed as to enable said secondary mirror frame to be pivoted about a transverse axle of said hinge coupler away from a compact storage and transit configuration overlying said primary mirror frame to a use configuration disposed radially outwardly from said primary mirror frame, whereby said annular illumination source is enabled to illuminate an object field in front of said primary mirror, and whereby said secondary mirror frame is rotatable about a radially disposed swivel axis of said hinge coupler to position said reflective surface of said secondary mirror facing away from said primary mirror, and said secondary mirror frame pivoted towards an orientation overlying said primary mirror and illumination source, whereby light from said illumination source is enabled to be transmitted through said annular light-transmissive bezel ring of said secondary mirror, and thereby illuminate an object field in front of said reflective surface of said secondary mirror.

2. A mirror device comprising;

a. a first, primary mirror having a first, primary mirror magnification factor, said primary mirror being mounted in a primary mirror frame, b. an illumination source effective in illuminating an object field in front of a front, reflecting side of said primary mirror, said illumination source being generally concentric with and at least partially circumscribing a peripheral edge of said primary mirror, c. a second, secondary mirror having a second, secondary mirror magnification factor different from said primary mirror magnification factor, said secondary mirror being mounted in a secondary mirror frame, said secondary mirror frame having a light transmissive region peripherally located with respect to said secondary mirror, d. means for releasably securing said secondary mirror in front of said primary mirror at an adjustable position in which said light transmissive region of said secondary mirror frame overlies said illumination source, whereby light from said illumination source is transmitted through said light transmissive region to thereby illuminate an object field in front of a front, reflecting side of said secondary mirror.

3. The mirror device of claim 2 wherein said means for releasably securing said secondary mirror at an adjustable position in front of said primary mirror is further defined as coupling means enabling translational relative motion between said primary and secondary mirror frames.

4. The mirror device of claim 3 wherein said coupling means is further defined as enabling rotational relative motion between said primary and secondary mirror frames.

5. The mirror device of claim 2 wherein said means for releasably securing said secondary mirror at an adjustable position in front of said primary mirror is further defined as a hinge coupler which is connected between said primary mirror frame and said secondary mirror frame, said hinge coupler having a first joint provided with a pivot axle disposed transversely to a pivot plane in which centers of said primary mirror and said secondary mirror lie, whereby said secondary mirror frame is pivotable from an orientation generally parallel to and overlying said primary mirror, to an orientation disposed generally radially outwardly from said primary mirror.

6. the mirror device of claim 5 wherein said hinge coupler is further defined as having a second, swivel joint having an axis which lies in said pivot plane, said swivel joint axis being disposed radially with respect to said secondary mirror frame and thereby enabling a reflected side of said secondary mirror to be directed opposite that of said primary mirror.

7. The mirror device of claim 2 wherein said means for releasably securing said secondary mirror at an adjustable position in front of said primary frame is further defined as coupling means enabling pivotable relative motion between said primary and secondary mirror frames about a first axis.

8. The mirror device of claim 7 wherein said coupling means is further defined as enabling swivelable relative motion between said primary and secondary mirrors about a second axis not collinear with said first axis.

* * * * *